US009145671B1

(12) United States Patent
Cornell

(10) Patent No.: US 9,145,671 B1
(45) Date of Patent: Sep. 29, 2015

(54) MODULAR HOUSING FRAMING SYSTEMS

(71) Applicant: Tim Cornell, Sherwood, OR (US)

(72) Inventor: Tim Cornell, Sherwood, OR (US)

( * ) Notice: Subject to any disclaimer, the term of this patent is extended or adjusted under 35 U.S.C. 154(b) by 0 days.

(21) Appl. No.: 14/263,596

(22) Filed: Apr. 28, 2014

(51) Int. Cl.
*E04B 1/19* (2006.01)
*E04H 1/00* (2006.01)

(52) U.S. Cl.
CPC ..... *E04B 1/1903* (2013.01); *E04B 1/19* (2013.01); *E04H 1/005* (2013.01)

(58) Field of Classification Search
CPC ..... E04B 1/34331; E04B 1/34384; E04B 1/34315; E04B 1/2403; E04B 1/1903; E04B 1/19; E04B 2001/2454; E04B 2001/2457; E04B 2001/268; E04B 2001/2406; E04H 1/005; E04C 2003/043; E04C 2003/0465
See application file for complete search history.

(56) References Cited

U.S. PATENT DOCUMENTS

| | | | | |
|---|---|---|---|---|
| 5,289,665 | A * | 3/1994 | Higgins | 52/655.1 |
| 5,820,289 | A * | 10/1998 | Kern et al. | 403/231 |
| 7,527,002 | B2 * | 5/2009 | Riser | 105/148 |
| 7,900,411 | B2 * | 3/2011 | Antonic | 52/275 |
| 8,733,048 | B1 * | 5/2014 | Hanson | 52/348 |
| 2008/0178551 | A1 * | 7/2008 | Porter | 52/653.1 |
| 2011/0179741 | A1 * | 7/2011 | Yen | 52/653.1 |
| 2011/0269579 | A1 * | 11/2011 | Henkel | 473/429 |
| 2014/0106108 | A1 * | 4/2014 | Lin et al. | 428/58 |

* cited by examiner

*Primary Examiner* — Jeanette E Chapman
(74) *Attorney, Agent, or Firm* — Mohr Intellectual Property Law Solutions, PC

(57) ABSTRACT

Modular home framing systems include a plurality of elongate rectangular vertical frame members, a plurality of elongate rectangular horizontal frame members, a plurality of connectors, and a plurality of fastening members, each of the plurality of fastening members configured to fasten any of the plurality of connectors to any of the plurality of vertical frame members and any of the plurality of horizontal frame members to any of plurality of connectors.

19 Claims, 18 Drawing Sheets

MODULAR HOUSING FRAMING SYSTEMS

BACKGROUND

The present disclosure relates generally to modular housing framing systems and components. In particular, modular house framing systems including components that can be releasably installed in various orientations and configurations are described.

Known modular housing framing systems and components are not entirely satisfactory for the range of applications in which they are employed. For example, existing modular housing framing systems and components include complex assembly processes that often requiring power tools and complex assembly processes. In addition, conventional modular housing framing systems and components cannot be releasably attached such that the components may be disassembled for reassembly in another location and/or additional framing components attached to an existing modular house frame.

Thus, there exists a need for modular housing framing systems and components that improve upon and advance the design of known modular housing framing systems. Examples of new and useful modular housing framing systems and components relevant to the needs existing in the field are discussed below.

SUMMARY

The present disclosure is directed to modular home framing systems. The modular house framing systems include a plurality of elongate rectangular vertical frame members, each of the plurality of vertical frame members having an upper vertical end and a lower vertical end, each of the upper vertical end and the lower vertical end having a horizontal member attachment mechanism in a horizontal member attachment region. Further, the modular house framing system include a plurality of elongate rectangular horizontal frame members, each of the plurality of horizontal frame members having a first horizontal end and a second opposing horizontal end, each of the first horizontal end and the second horizontal end having a vertical member attachment mechanism and an end face in a vertical member attachment region, the end face being open and including a central void that is at least partially extended into a body of the horizontal frame member. Furthermore, the modular house framing systems include a plurality of connectors, each of the plurality of connectors having a generally rectangular cuboidal projection, the generally rectangular cuboidal projection being at least a pair of side walls outwardly extended from a vertical member abutting wall, the projection being insertable into the central void of the horizontal frame member and being complimentarily configured with a shape of an internal perimeter of the central void, each of the universal connectors being attachable to the horizontal member attachment mechanism and the vertical member attachment mechanism. Further still, the modular house framing systems include a plurality of fastening members, each of the plurality of fastening members configured to fasten any of the plurality of connectors to any of the plurality of vertical frame members and any of the plurality of horizontal frame members to any of plurality of connectors.

DETAILED DESCRIPTION

Figure 1:
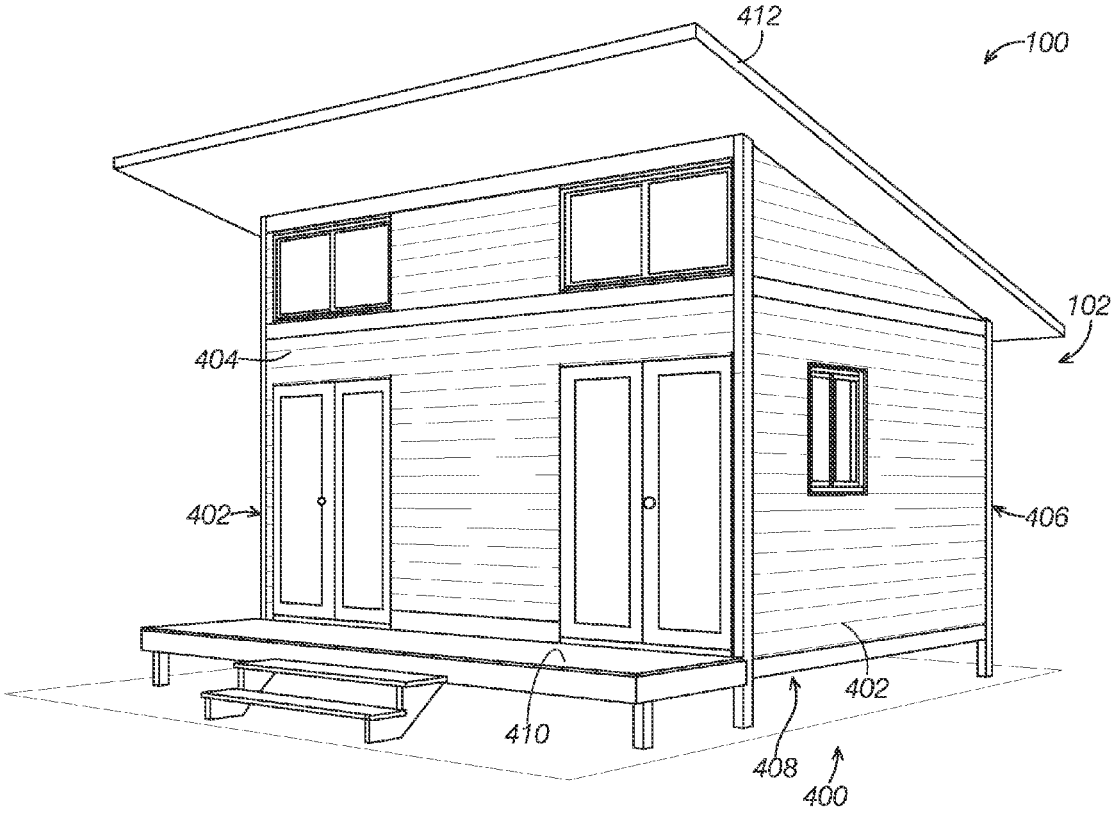
FIG. 1 is a perspective view of a first example of a modular house.

The disclosed modular housing framing systems and components will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various modular housing framing systems and components are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-17B, a first example of a modular house, modular house 100, will now be described. Modular house 100 includes a framing system 102 (i.e., a frame 102), a pair of side panels 402, a front panel 404, a rear panel 406, a floor panel 408, a porch panel 410, and a roof panel 412.

The modular house can be easily assembled with or without power tools. Further, additional components can be easily added to a side, a rear, or a top of the modular house for expansion of the house. Additionally or alternatively, the modular house can be easily disassembled and/or reassembled (e.g., disassembled and moved to another location for assembly). Further, additional components can easily be added to expand the house and/or change the configuration of the house. For example, additional components can be added to vertically expand the house. In another example, additional components can be added to horizontally expand the house.

With reference to FIGS. 2-16, framing system 102 includes vertical frame members 104 (104*a*, 104*b*) and 106 (106*a*, 106*b*), horizontal frame members 108 (108*a-j*) and 110 (110*a*, 110*b*), and foot members 112. Vertical frame members 104 are longer than vertical frame members 106. Horizontal frame members 108 are longer than horizontal frame members 110. Horizontal frame members 108 and 110 are attachable to vertical frame members 104 and 106. Foot members 112 are attachable to ends of vertical frame members 104 and 106 for making contact between frame 102 the ground and/or a foundation for house.

It may be advantageous for transportation and assembly of the framing components that the framing components be light-weight. Accordingly, the vertical frame member, the horizontal frame members, and/or the foot members can be elongate hollow rectangular tubes. Further, the vertical frame member, the horizontal frame members, and/or the foot members can be made fabricated from a relatively light weight material (e.g., aluminum, fiberglass, thinner carbon fiber, etc.).

Alternatively, it may be advantageous that the framing components be sturdy. Accordingly, in this alternate example, the vertical frame member, the horizontal frame members, and/or the foot members can be solid elongate rectangular members with some hollow areas (as required for assembly). Further, the vertical frame member, the horizontal frame members, and/or the foot members can be made fabricated from a relatively heavy weight material (e.g., steel, thicker carbon fiber, etc.).

Figure 2:
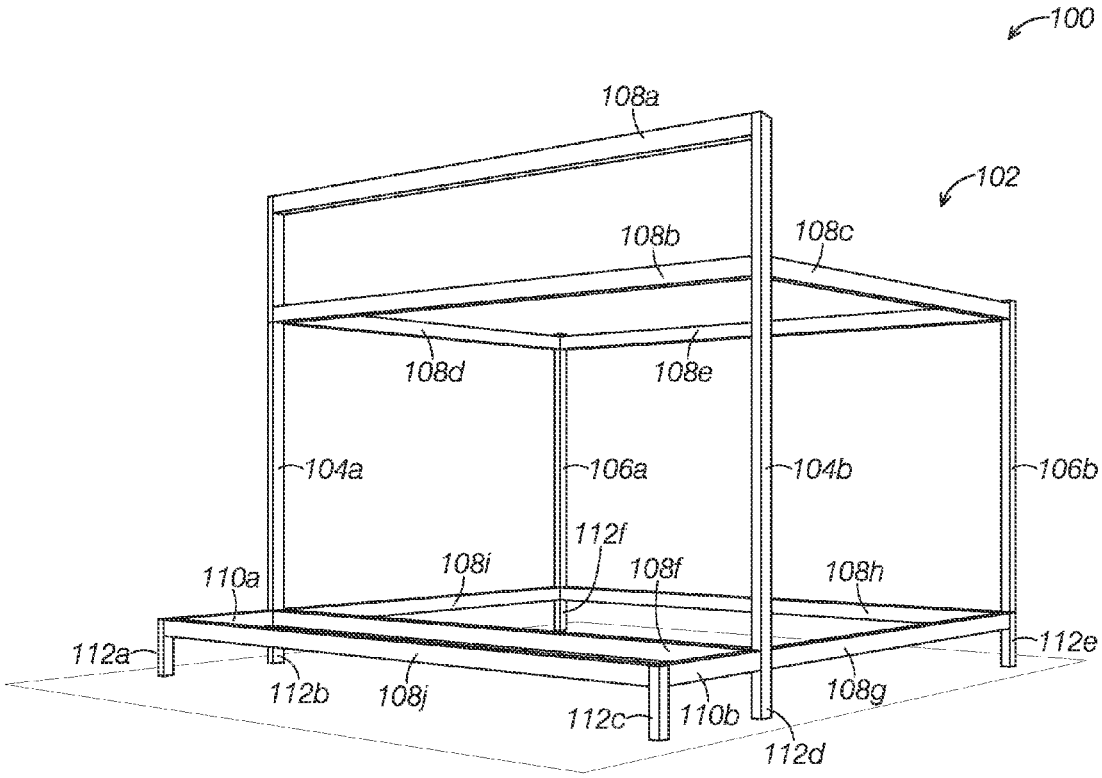
FIG. 2 is a perspective view of a framing system and framing components for the modular house shown in FIG. 1.

As shown in FIGS. 1 and 2, in one example, framing system 102 can be assembled with two of the longer vertical frame members, vertical frame members 104*a* and 104*b*, on opposing lateral sides of a front of modular house 100 and two of the shorter vertical frame member, vertical frame members 106*a* and 106*b*, on opposing lateral sides of a rear of modular house 100. Because of this arrangement of vertical frame member, roof panel 412 (as shown in FIG. 1) is disposed at an inclination when attached to the frame. In other examples, four of the greater length vertical frame members (e.g., vertical frame members 104) can be used to give the house a flat roof with a greater ceiling clearance. In still other examples, four of the shorter length vertical frame members (e.g., vertical frame members 106) can be used to give the house a flat roof with a lower ceiling clearance.

Also in the example of FIGS. 1 and 2, it is shown that framing system 102 can be assembled with ten horizontal frame members 108 (108*a-j*) and two horizontal frame members 110 (110*a* and 110*b*): one provided between a top of the longer vertical member (108*a*), four framing a top of the modular house (108*b-e*), four framing a bottom of the modular house (108*f-i*), and four framing the porch (108*f*, 108*j*, 110*a*, and 110*b*). In this example, horizontal frame members 108*a* and 108*e* are configured to support roof panel 412 and horizontal frame members 108*f-i* are configured to support floor panel 408. Horizontal frame members 108*j*, 108*f*, 110*a*, and 110*b* are configured to support porch panel 410.

In other examples, the longer horizontal frame members can be used instead of the shorter horizontal frame members to give the house a larger porch. In yet other examples, four of the horizontal frame members (e.g., frame members 108*c*, 108*d*, 108*g*, and 108*i*) can be substituted with shorter horizontal frame members to give the house a decreased depth.

It will be appreciated that the above described examples are selected example configurations for a modular house (e.g., modular house 100). It will be further appreciated that the various vertical frame members, horizontal frame members, and foot members can be assembled in any desired configuration. In some examples, the house can be configured to have a greater height and/or additional levels (e.g., additional stories). In other examples, the house can be configured to have a greater width and/or depth (i.e., a larger footprint). Further, as the frame members can be assembled, disassembled, and reassembled, the house can be reconfigured and/or moved to a different location as desired.

Figure 3A:
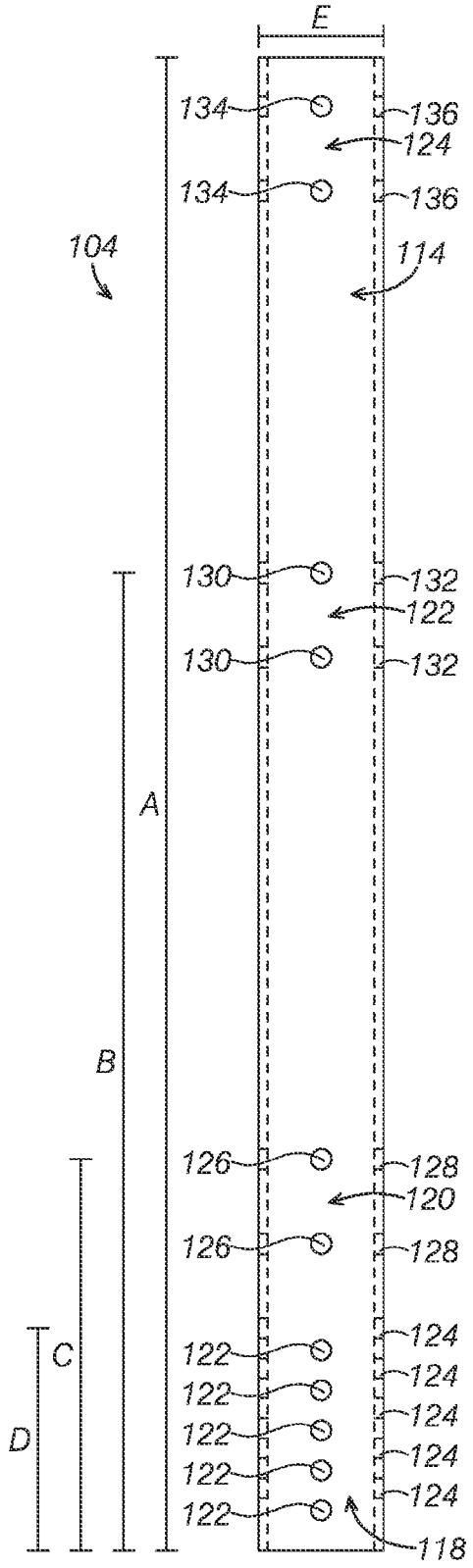
FIGS. 3A and 3B are a first side plan view and a second side plan view, the second side view being a 90° rotation relative to the first side view, of a first example vertical frame member.
Figure 3B:
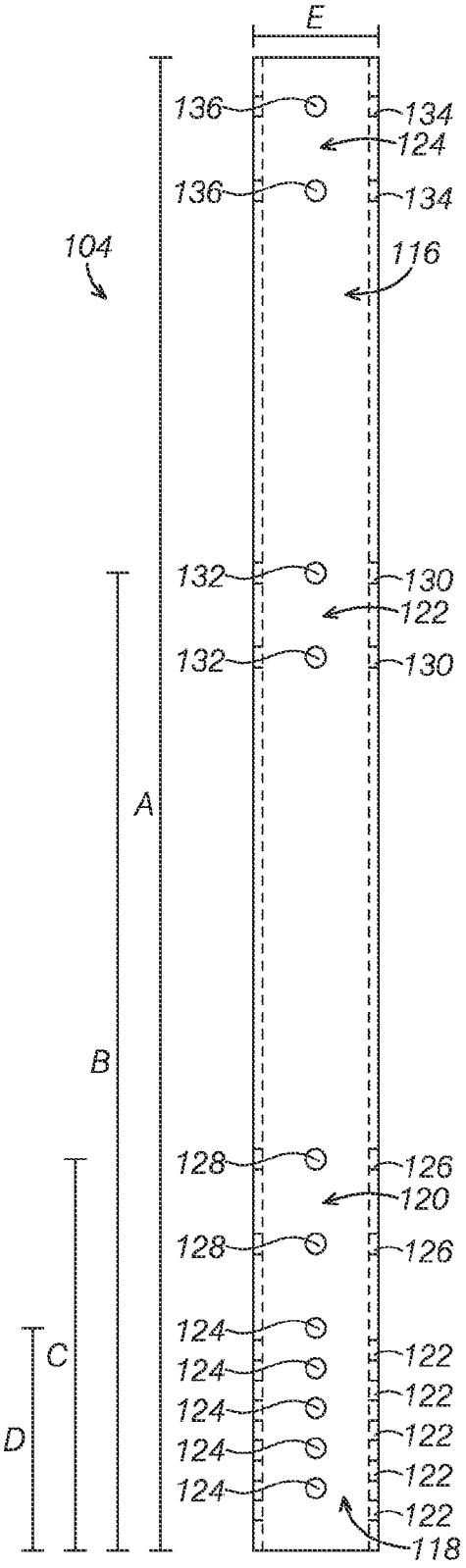

Turning now to FIGS. 3A-16, components of framing system 102 will now be described in detail. FIGS. 3A and 3B depict a longer vertical frame member, vertical frame member 104. FIG. 3A shows a first face 114 and FIG. 3B shows a second face 116 of vertical frame member 104. Second face 116 is a 90° rotation relative to first face 114. It will be appreciated that, although not specifically depicted, opposing faces (i.e., sides) of vertical frame member 104 (e.g., an opposing face relative to first face 114 and first face 114, an opposing face relative to second face 116 and second face 116) have identical configurations.

Vertical frame member 104 includes a foot member attachment region 118, a lower horizontal member attachment region 120, a central horizontal member attachment region 122, and an upper horizontal member attachment region 124. Vertical frame member 104 has an overall height A, and a top of upper horizontal attachment region 124 is substantially located at height A. A top of central horizontal member attachment region 122 is substantially located at a height B, while a top of lower horizontal member attachment region 120 is substantially located at a height C. A top of the foot member attachment region 118 is substantially located at a height D.

In the present example, the height A is greater than the height B, the height B is greater than the height C, and the height C is greater than the height D. In one specific example, the height A is 12' and 10⅝", the height B is 9' and 8⅛", the height C is 11", and the height D is 5⅝". Further, vertical frame member 104 has depth/width E. In one specific example, the depth/width E is 3½".

As shown in FIGS. 3A and 3B, foot member attachment region 122 includes a plurality of laterally extended holes 122 that extend through first face 114 to the opposing face of vertical frame member 104 (not specifically shown). Also shown in FIGS. 3A and 3B, foot member attachment region 122 further includes a plurality of laterally extended holes 124 that extend through second face 116 to the opposing face of vertical frame member 104 (not specifically shown).

FIGS. 3A and 3B show that, in this example, holes 122 are offset relative to holes 124. In other words, each of holes 122 is located immediately beneath one of holes 124. In other examples, holes 122 and 124 can be aligned. In the depicted example, holes 122 and 124 each include five holes. In other examples, holes 122 and 124 may include more or fewer holes.

Horizontal member attachment region 120 includes holes 126 and 128, horizontal member attachment region 122 includes holes 130 and 132, and horizontal member attachment region 124 includes holes 134 and 136. In this specific example, each of holes 126, 128, 130, 132, 134, and 136 includes two holes. In other examples, each of holes 126, 128, 130, 132, 134, and 136 may include more of fewer holes.

As shown in FIGS. 3A and 3B, holes 126, 130, and 134 are laterally extended holes that extend through first face 114 to the opposing face of vertical frame member 104 (not specifically shown). Also shown in FIGS. 3A and 3B, holes 128, 132, and 136 are laterally extended holes that extend through second face 116 to the opposing face of vertical frame member 104 (not specifically shown).

Different from the sets of holes in foot member attachment region 118, the sets of holes in horizontal member attachment regions 120, 122, and 124 are not offset. Thus, pathways of set of holes in each region (e.g., holes 126 and 128, holes 130 and 132, and holes 134 and 136) are aligned and intersect at a center of vertical frame member 104. This specific configuration is desirable so that horizontal frame members can be attached any face of the vertical frame member in a manner that will allow the vertical members to be disposed at the same height (e.g., heights A, B, or C) as adjacently attached horizontal frame members. For example, as shown in FIG. 2, adjacent horizontal members 108*g*, 108*h*, 108*i*, and 108*j* are disposed at the same height so that they can equally support a floor panel.

Figure 4A:
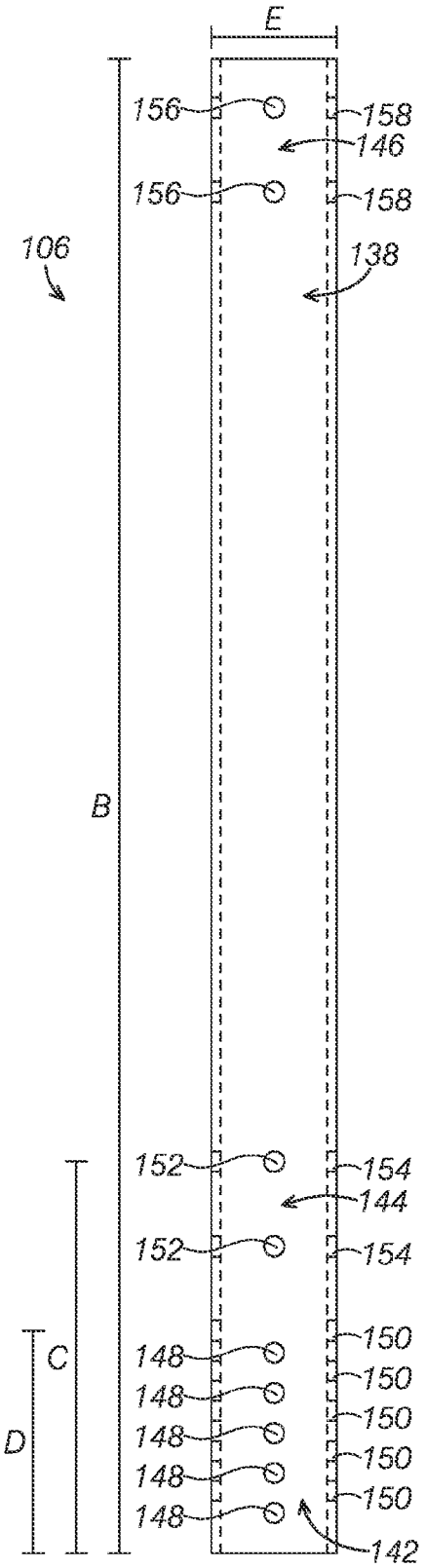
FIGS. 4A and 4B are a first side plan view and a second plan side view, the second side view being a 90° rotation relative to the first side view, of a second example vertical frame member.
Figure 4B:
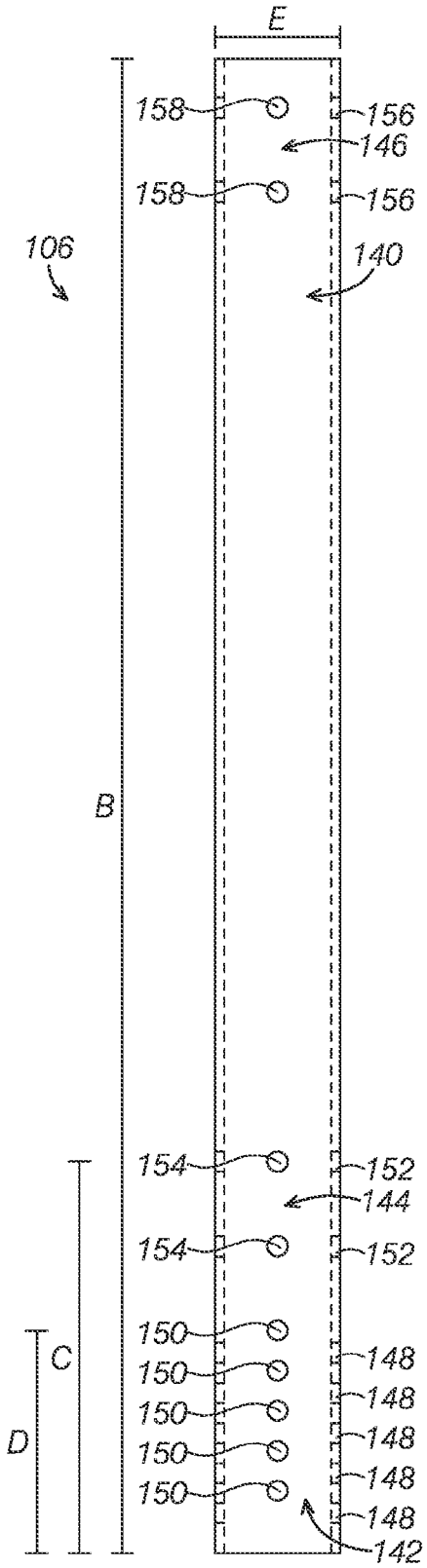

Another configuration for a shorter vertical frame member, vertical frame member 106, is shown in FIGS. 4A and 4B. FIG. 4A shows a first face 138 and FIG. 4B shows a second face 140 of vertical frame member 106. Second face 140 is a 90° rotation relative to first face 138. It will be appreciated that, although not specifically depicted, opposing faces (i.e., sides) of vertical frame member 106 (e.g., an opposing face relative to first face 138 and first face 138, an opposing face relative to second face 140 and second face 140) have identical configurations.

Vertical frame member 106 is shorter than vertical frame member 104, having an overall height B. Vertical frame member includes a foot member attachment region 142, a lower horizontal member attachment region 144, and an upper horizontal member attachment region 146.

A top of upper horizontal member attachment region 146 is substantially located at height B, while a top of lower horizontal member attachment region 144 is located at height C. A top of foot member attachment region 142 is located at height D. Further, vertical frame member 106 has a width/depth E. In one specific example, the heights B, C, and D and the depth/width E are the same as the dimensions given above in reference to vertical member 104 (shown in FIGS. 3A and 3B).

Similarly to foot member attachment region 118 (shown in FIGS. 3A and 3B), foot member attachment region 142 includes a plurality of laterally extended holes 148 that extend through first face 138 to the opposing face of vertical frame member 106 (not specifically shown). Also shown in FIGS. 3A and 3B, foot member attachment region 142 further includes a plurality of laterally extended holes 150 that extend through second face 140 to the opposing face of vertical frame member 106 (not specifically shown).

In this example, holes 148 are offset relative to holes 150. In other words, each of holes 148 is located below one of holes 150. In other examples, holes 148 and 150 can be aligned. In the depicted example, holes 148 and 150 each include five holes. In other examples, holes 148 and 150 may include more or fewer holes.

Each of horizontal member attachment regions 144 and 146 has a similar configuration to horizontal member attachment regions 120, 122, and 124 shown in FIGS. 3A and 3B. Accordingly, horizontal member attachment region 144 includes holes 152 and 154, and horizontal member attachment region 146 includes holes 156 and 158. In this specific example, each of holes 152, 154, 156, and 158 includes two holes. In other examples, each of holes 152, 154, 156, and 158 may include more of fewer holes.

As shown in FIGS. 4A and 4B, holes 152 and 156 are laterally extended holes that extend through first face 138 to the opposing face of vertical frame member 106 (not specifically shown). Also shown in FIGS. 4A and 4B, holes 154 and 158 are laterally extended holes that extend through second face 140 to the opposing face of vertical frame member 104 (not specifically shown).

Different from sets of holes in foot member attachment regions 118 and 142, the sets of holes in horizontal member attachment regions 144 and 146 are not offset. Thus, set of holes in each region (e.g., holes 152 and 154, holes 156 and 158) are aligned. This specific configuration is desirable so that horizontal frame members can be attached at any face of the vertical frame member and will be disposed at the same height (e.g., heights B or C) as adjacently attached horizontal frame members.

It will be appreciated that the vertical frame member 106 can be used in combination with vertical frame member 104 in construction of a frame for a modular home. As discussed above and shown in FIG. 2, horizontal frame members (e.g., horizontal frame members 108*c*, 108*d*, 108*g*, 108*i*) can be attached to both of vertical frame member 104 and vertical frame member 106 because horizontal member attachment regions 120 and 144, and 124 and 146 are located at the same heights, C and B, respectively. Vertical frame members 104 have an additional horizontal attachment member region at height A (i.e., horizontal attachment member region 124). A horizontal member can be attached to vertical frame members 104 at horizontal attachment member region 124 to either support an inclination of roof panel 412 (shown in FIG. 1) or provide an overall higher ceiling clearance.

Figure 5A:
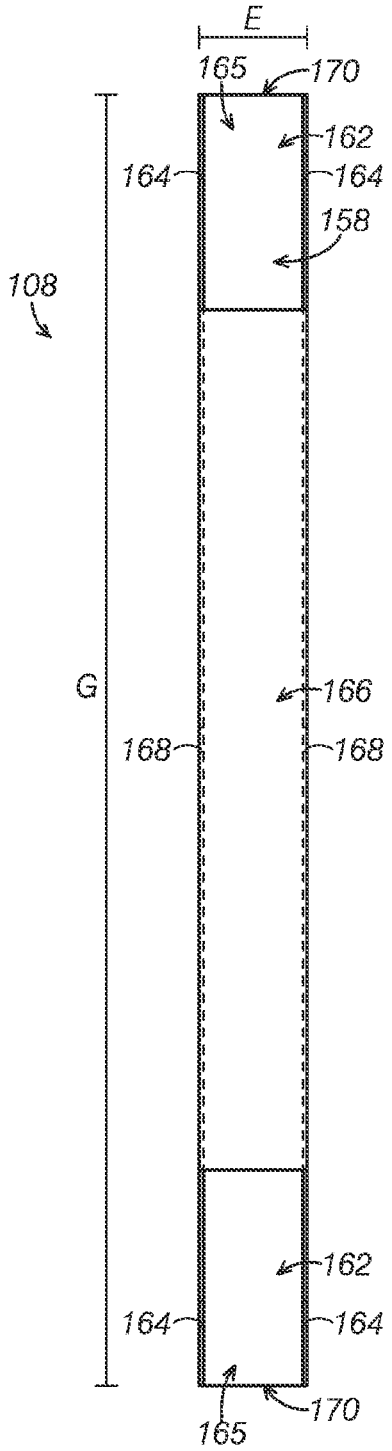
FIGS. 5A and 5B are a first side plan view and a second plan side view, the second side view being a 90° rotation relative to the first side view, of a first example horizontal frame member

Turning now to FIGS. 5A-6B, horizontal frame members 108 and 110 will now be described in detail. FIGS. 5A and 5B show a longer horizontal frame member 108. FIG. 5A shows a first face 158 and FIG. 5B shows a second face 160 of horizontal frame member 108. Second face 160 is a 90° rotation relative to first face 158. It will be appreciated that, although not specifically depicted, opposing faces (i.e., sides) of horizontal frame member 108 (e.g., an opposing face relative to first face 158 and first face 158, an opposing face relative to second face 160 and second face 160) have similar configurations. First face 158 differs from the opposing face by including a cutout portion 165 at opposing ends of the horizontal frame member.

Horizontal frame member 108 includes vertical frame member attachment regions 162 disposed at opposing ends of the horizontal frame member. Horizontal frame member 108 further includes a central attachment region 166 for optional attachment of an additional horizontal member via an additional connector (this configuration is not specifically shown in the figures). An additional horizontal member may be attached at the central attachment region to provide additional support of a floor panel and/or a roof panel.

Figure 5B:
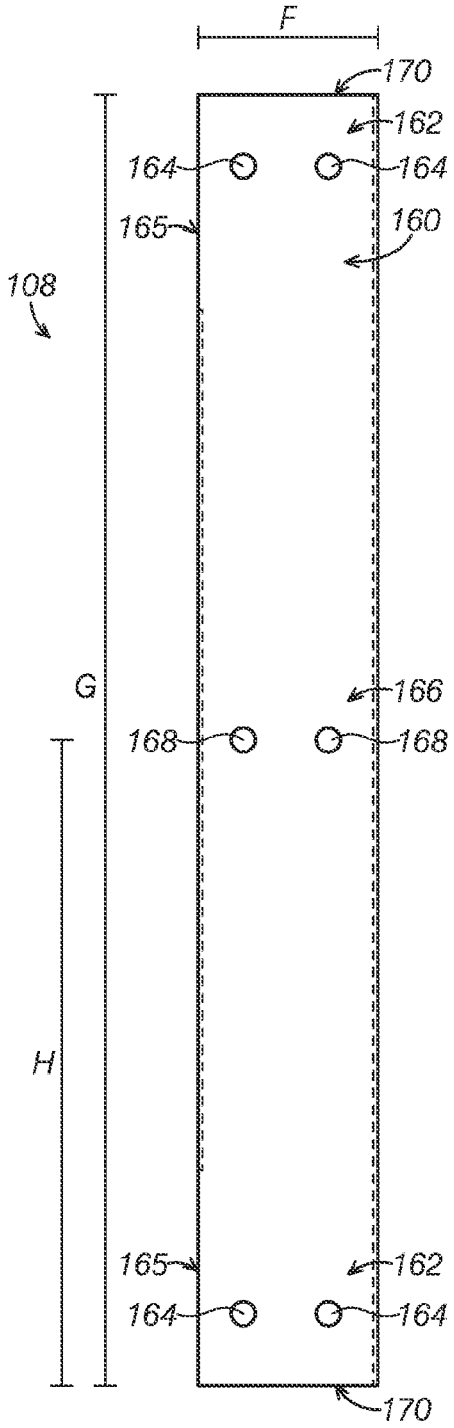

As shown in FIGS. 5A and 5B, vertical frame member attachment regions 162 include laterally extended holes 164 that extend through second face 160 to an opposing face of the horizontal frame member (not specifically shown). In the present example, holes 162 include two holes. In other examples, holes 162 may include more or fewer holes.

Central horizontal member attachment region 166 has a similar configuration to vertical frame member attachment regions 162. As depicted in FIGS. 5A and 5B, horizontal member attachment region 166 includes laterally extended holes 168 that extend through second face 160 to an opposing face of the horizontal frame member (not specifically shown). In the present example, holes 166 include two holes. In other examples, holes 166 may include more or fewer holes.

Horizontal frame member 108 further includes open end faces 170 at opposing ends of the frame member. A central void 182 (shown in FIGS. 10 and 13) is disposed within each of the open end faces 170. In the present example, the horizontal frame member is substantially hollow, and thus the central void extends through the horizontal frame member. In alternate examples where the horizontal frame member is substantially solid, the central void may extend only partially into the horizontal frame member.

Horizontal frame member 108 has an overall length G and a center point is a distance H (i.e., one half of the length G). As attachment region 166 is located in a center of horizontal member 108, attachment region 166 is located at the distance H. Further, horizontal frame member 108 has a width E and a height F. In one specific example, the length G is 12', the distance H is 6', and the height F is 5".

In this example, the width E is the same as the depth/width E described above. Thus, in this example, horizontal frame member 108 has a rectangular cross section with the smaller edge having the same width as the vertical frame members. In an alternate example, the height F may be equal to the width E. In this alternate example, the horizontal frame member has an overall square cross section rather than the rectangular cross section of horizontal frame member 108.

Figure 6A:
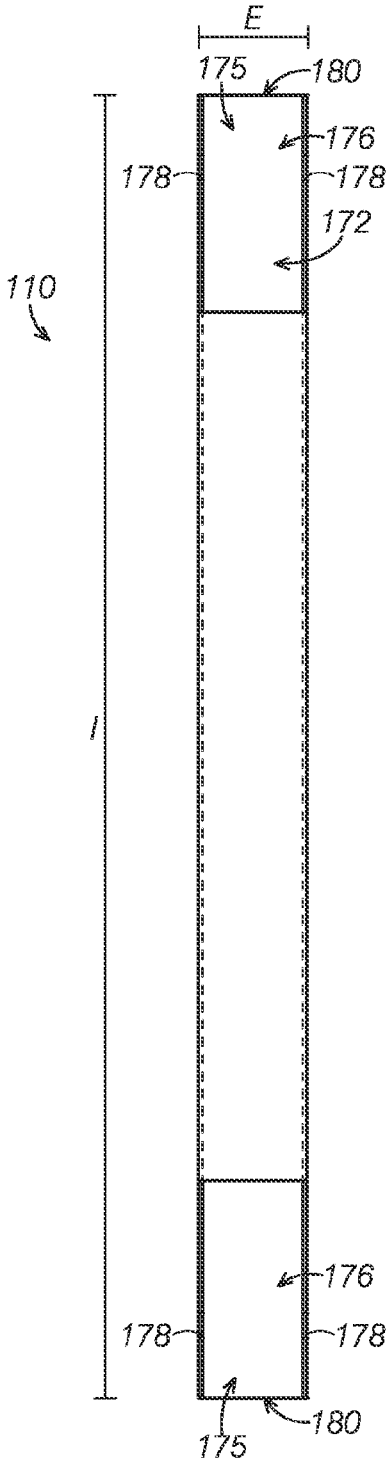
FIGS. 6A and 6B are a first side plan view and a second plan side view, the second side view being a 90° rotation relative to the first side view, of a second example horizontal frame member.
Figure 6B:
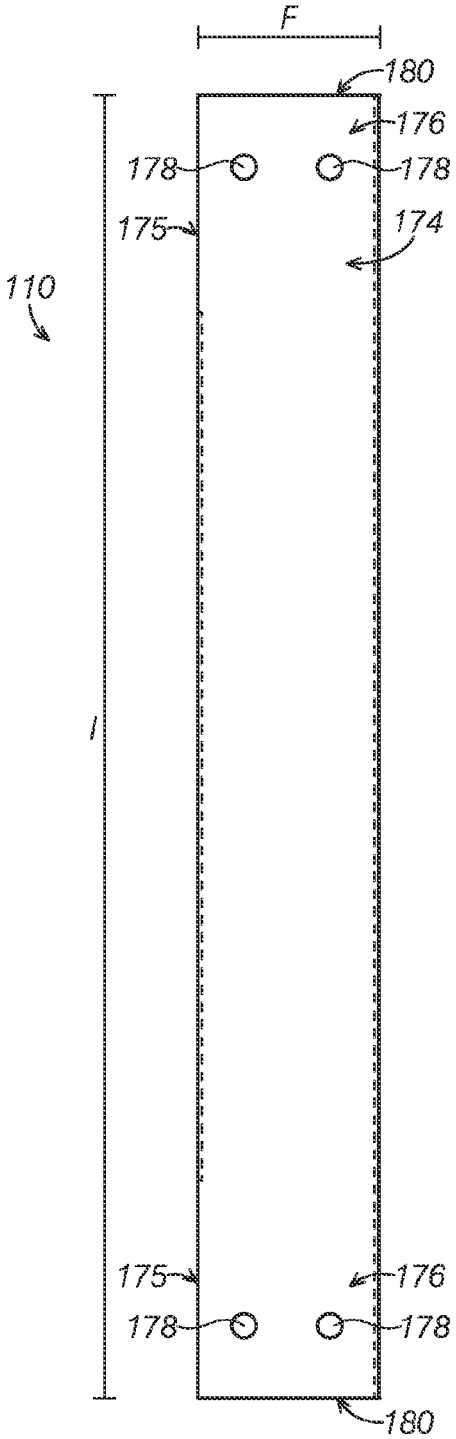

A configuration for a shorter horizontal frame member, horizontal frame member 110, is shown in FIGS. 6A and 6B. FIG. 6A shows a first face 172 and FIG. 6B shows a second face 174 of horizontal frame member 110. Second face 174 is a 90° rotation relative to first face 172. It will be appreciated that, although not specifically depicted, opposing faces (i.e., sides) of horizontal frame member 108 (e.g., an opposing face relative to first face 172 and first face 172, an opposing face relative to second face 174 and second face 174) have similar configurations. First face 172 differs from the opposing face by including a cutout portion 175 at opposing ends of the horizontal frame member.

Horizontal frame member 110 includes vertical frame member attachment regions 176 disposed at opposing ends of the horizontal frame member. Similarly configured as vertical member attachment regions 162, vertical frame member attachment regions 176 include laterally extended holes 178 that extend through second face 174 to an opposing face of the horizontal frame member (not specifically shown). In the present example, holes 178 include two holes. In other examples, holes 178 may include more or fewer holes.

Horizontal frame member 110 further includes open end faces 180 at opposing ends of the frame member. A central void (not specifically depicted, but having substantially the same configuration as central void 182 shown in FIGS. 10 and 13) is disposed within each of the open end faces 170. In the present embodiment, the horizontal frame member is substantially hollow, and thus the central void extends through the horizontal frame member. In alternate embodiments where the horizontal frame member is substantially solid, the central void may extend only partially into the horizontal frame member.

Horizontal frame member 110 has an overall length I. Further, horizontal frame member 108 has a width E and a height F. In one specific example, the length I is 4'.

In this example, the width E is the same as the depth/width E described above. Thus, in this example, horizontal frame member 110 has a rectangular cross section with the smaller edge having the same width as the vertical frame members. In an alternate example, the height F may be equal to the width E. In this alternate example, the horizontal frame member has an overall square cross section rather than the rectangular cross section of horizontal frame member 110.

Horizontal members can be attached to vertical members via connectors. Turning now to FIGS. 7-11, a first example connector, connector 200 will now be described. Connector 200 has an overall rectangular cuboid shape and includes a vertical member abutting wall 202, two opposing side walls 204, an end wall 206, and a centrally disposed space 208. Side walls 204 are extended between walls 202 and 206, end wall 206 being on an opposing side relative to the vertical member abutting wall 202. Centrally disposed space 208 is within the four walls 202, 204, and 206. Thus, universal connector 200 has an open top face and bottom face.

Further, each of side walls 204 is internally tapered. In other words, the two side walls are wider at a location of intersection with the vertical member abutting wall and are narrower at a location of intersection with the end wall. Thus, an internal surface of the side walls is angled. The wider portion of the tapered side walls is configured to provide increased structural support and/or integrity at a location where structural stress factors are greatest on the universal connector. The thinner portion of the tapered side walls is configured to require less material for construction, thereby decreasing overall weight and cost of material for the universal connector.

Connector 200 has an overall height J, an overall width K, and an overall length L. In one specific example, the height J is 4⅞", the width K is 2⅝", and the length L is 6".

Figure 7:
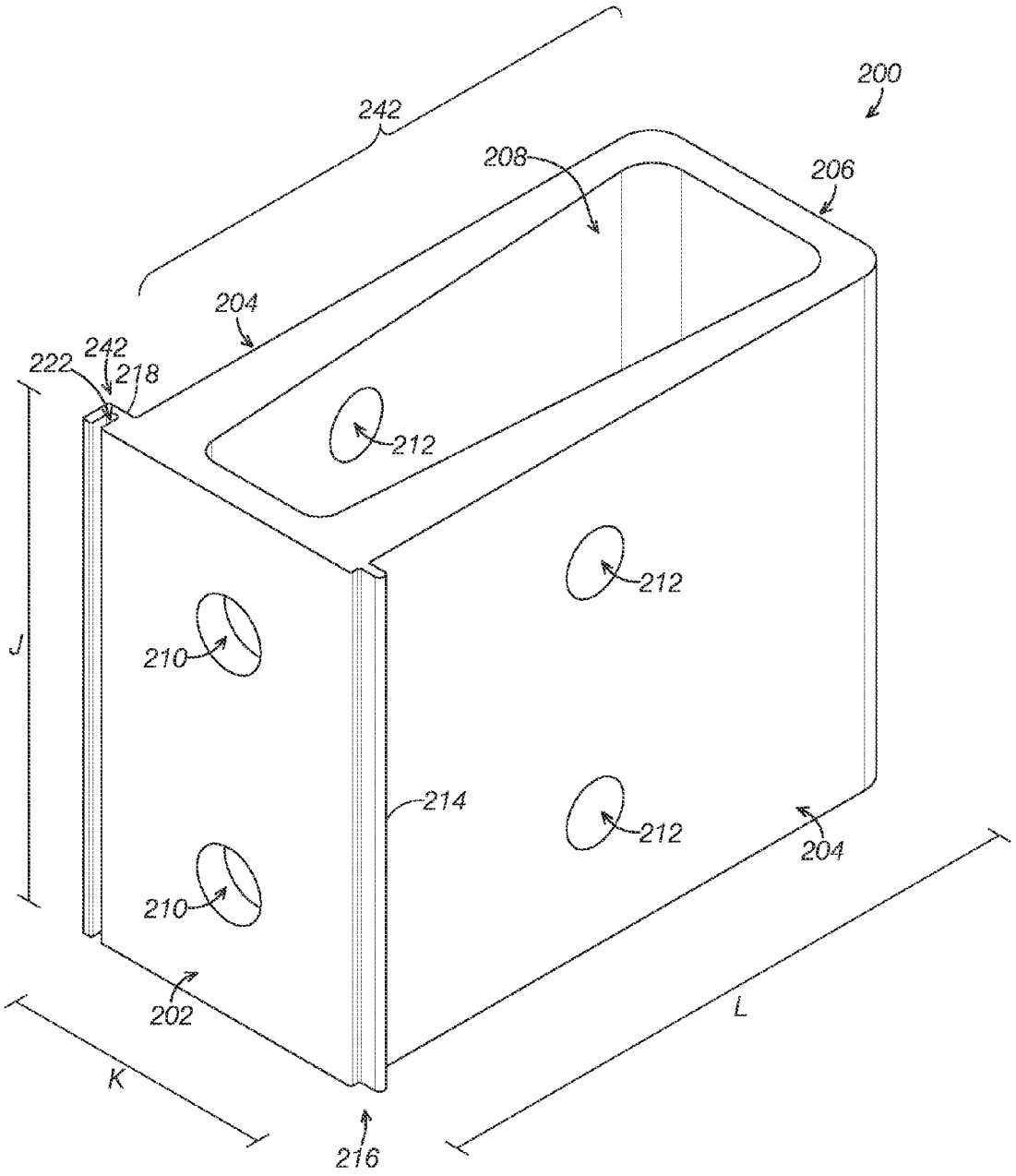
FIG. 7 is a perspective view of a first example of a first example connector.

As shown in FIG. 7, vertical member abutting wall 202 includes holes 210 for attachment of connector 200 to one face of a vertical member (e.g., face 114 of vertical member 104, face 138 of vertical member 106, etc.) at a horizontal member attachment region (e.g., horizontal member attachment regions 120, 124, 144, etc.). For example, a fastening member (not specifically shown) can be inserted through and fastened into one of holes 210 and one of holes 126 when connector 200 is aligned with a horizontal member attachment region 120. Further, an additional fastening member can be inserted through and fastened into the other of holes 210 and the other of holes 126.

Figure 8:
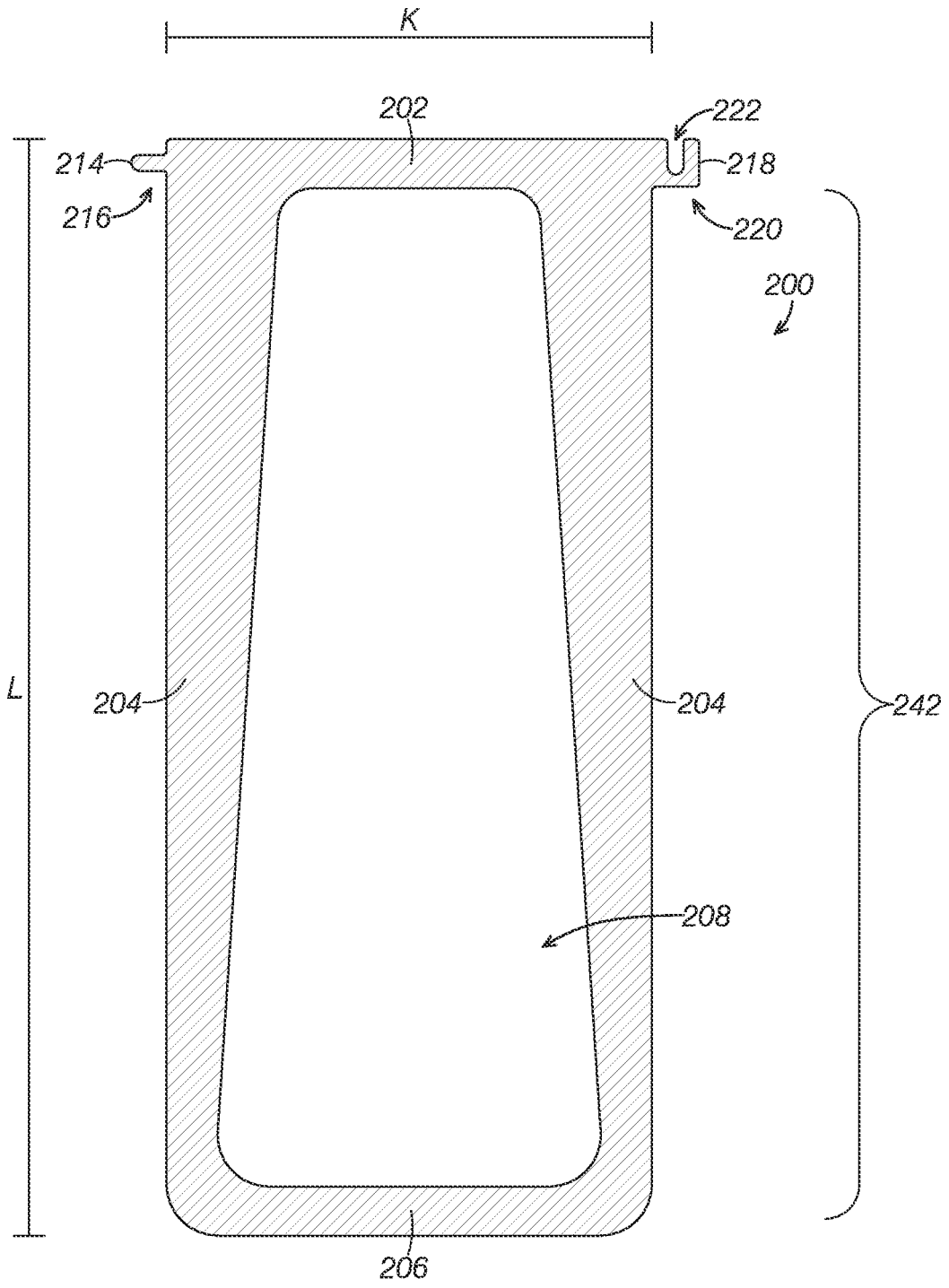
FIG. 8 is a cross sectional top view of the first example connector of FIG. 7.

As shown in FIGS. 7 and 8, vertical member abutting wall 202 further includes a male flange 214 on a first edge 216 and a female flange 218 on a second opposing edge 220. Female flange 220 includes a male flange receiving channel 222. Male flange 214 is configured to be insertable into the female flange of an adjacent connector for alignment and engagement of adjacent connectors.

Figure 9:
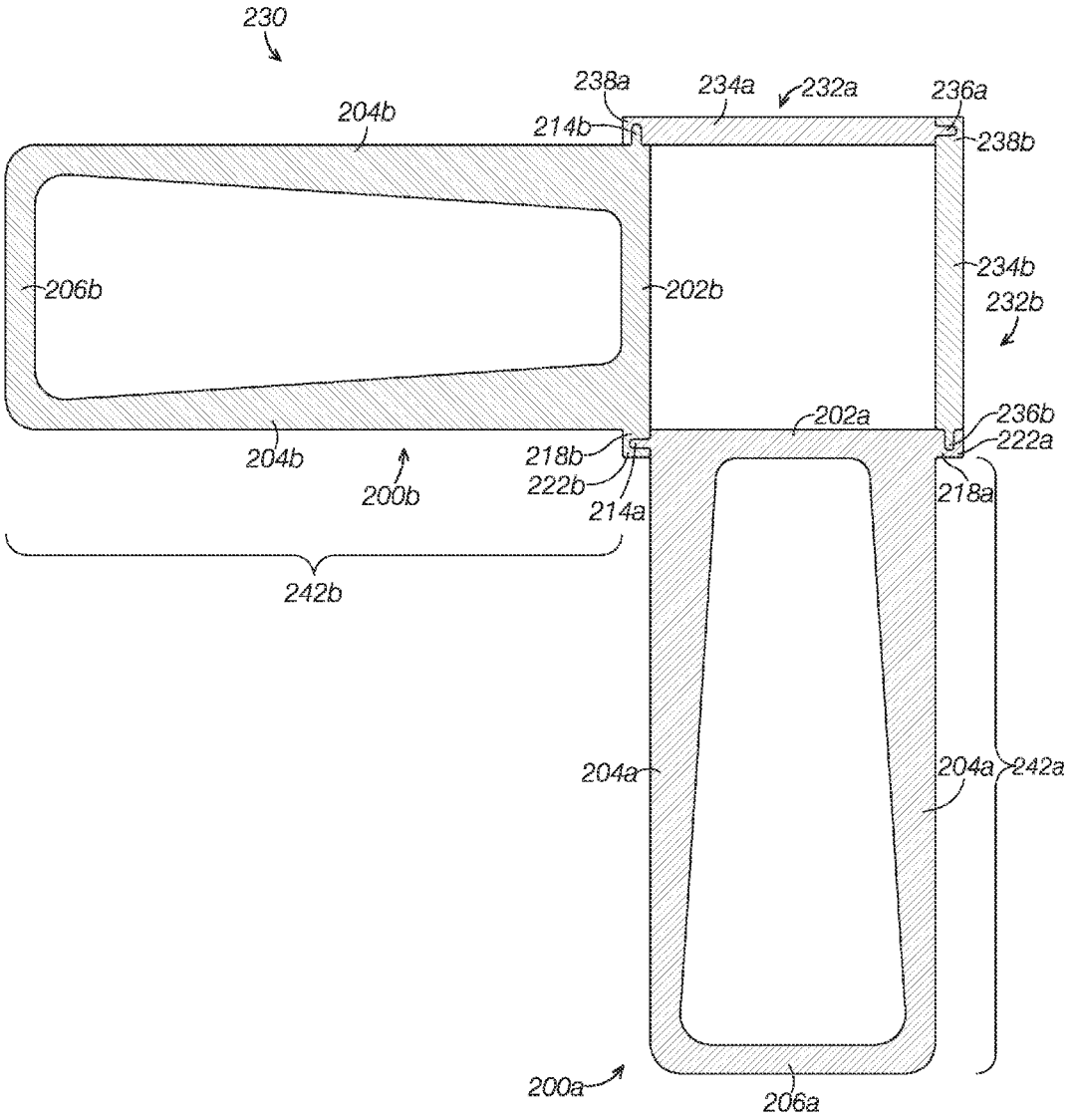
FIG. 9 is a cross sectional top view of a first example vertical member sleeve including the first example connector of FIG. 7.
Figure 10:
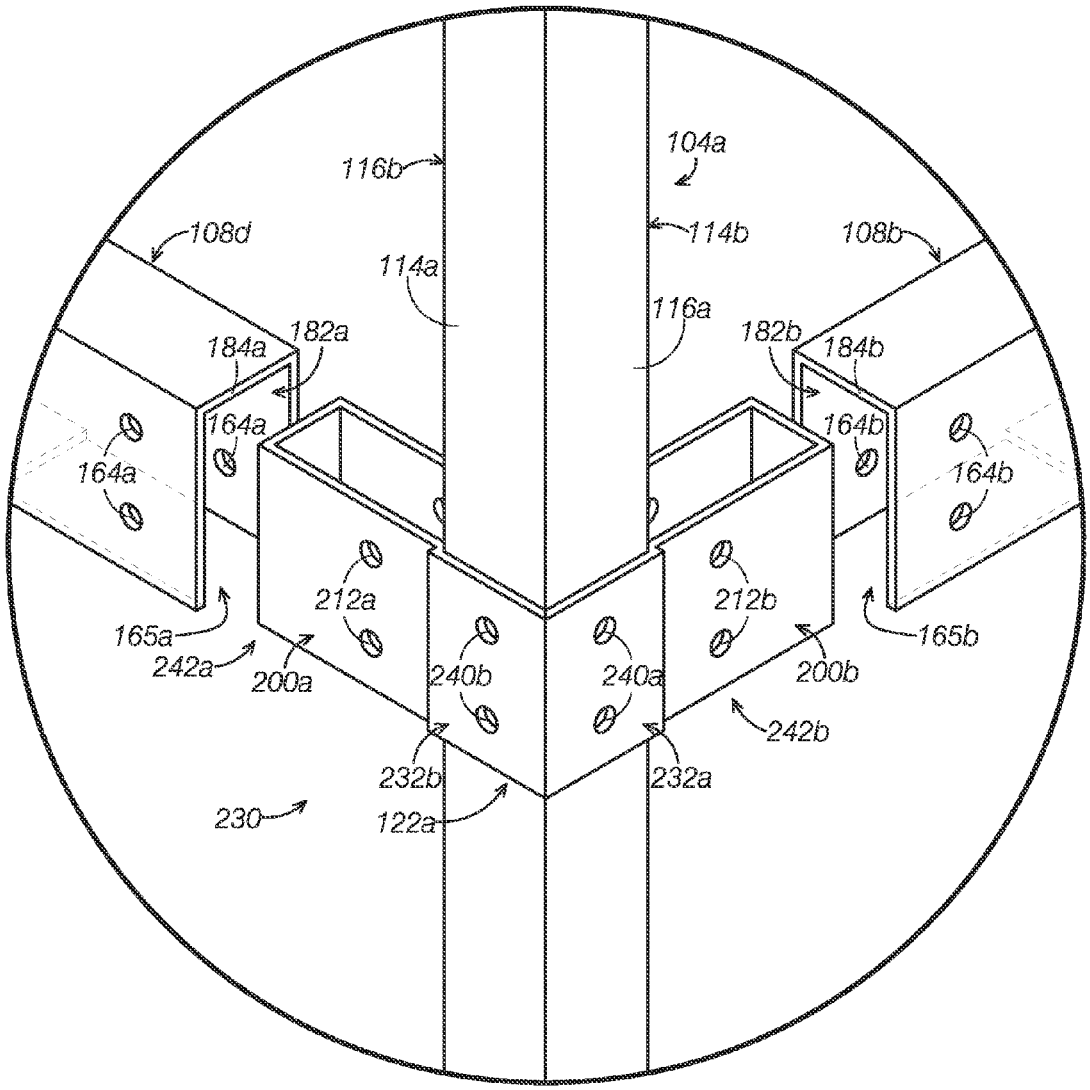
FIG. 10 is an isometric view of the first example vertical member sleeve in an aligned position for engagement with a vertical frame member and two horizontal frame members.
Figure 11:
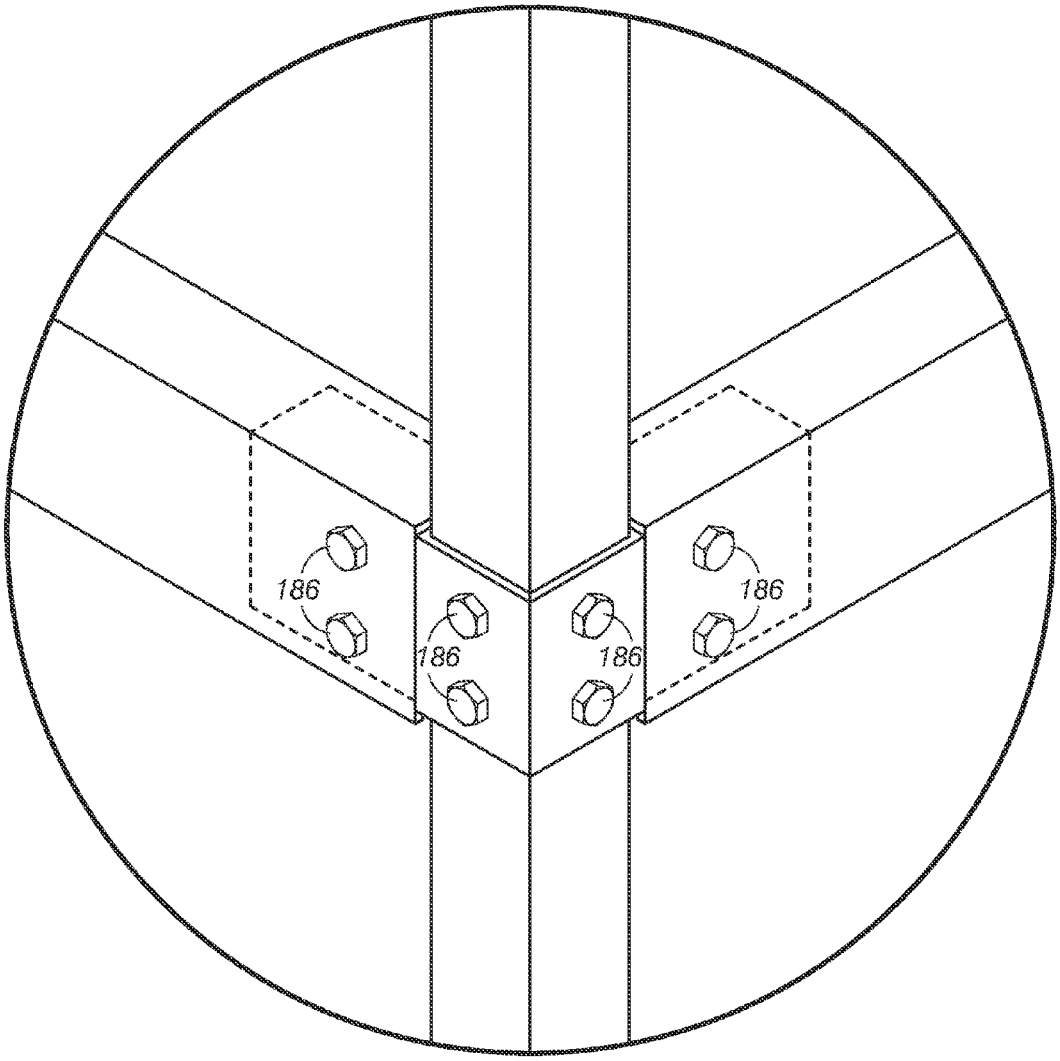
FIG. 11 is an isometric view of the first example vertical member sleeve engaged with the vertical member and the two horizontal frame members of FIG. 10.
Figure 12A:
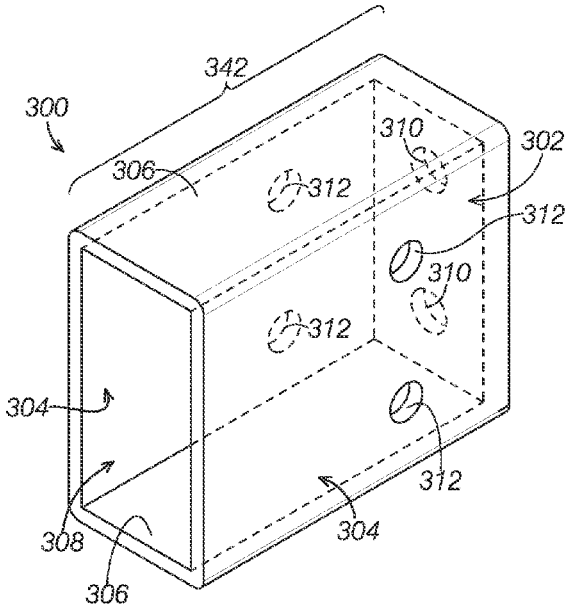
FIGS. 12A-12E are front isometric, rear isometric, rear plan, top plan, and side plan views, respectively, of a second example connector.
Figure 12C:
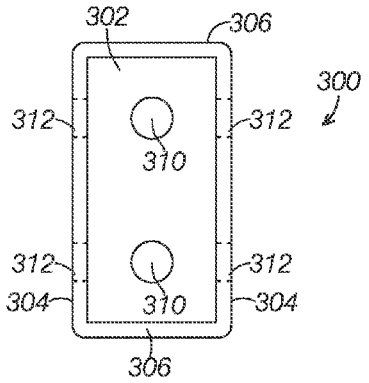
Figure 12D:
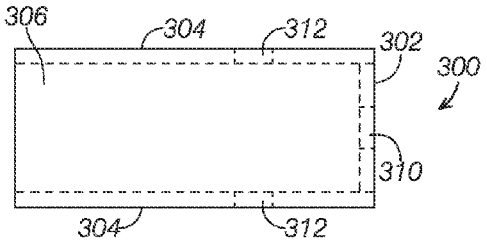
Figure 12B:
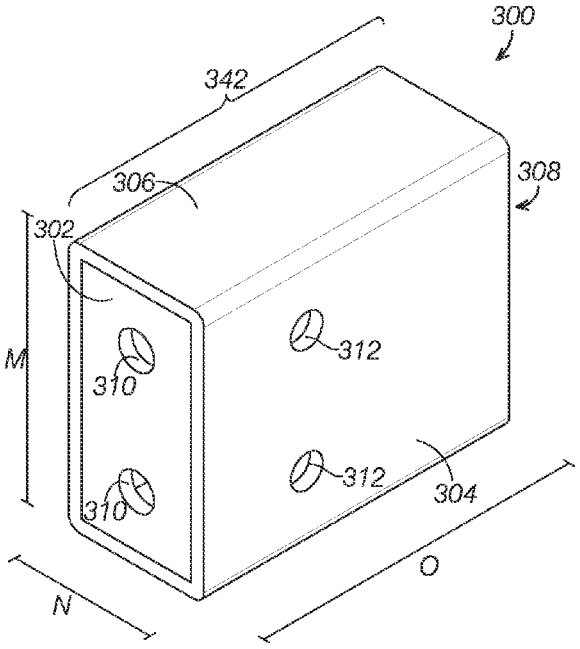
Figure 12E:
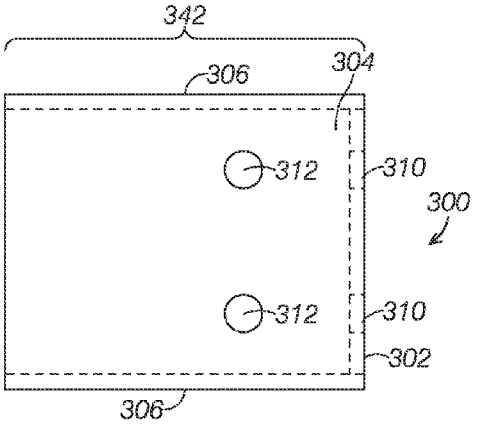

FIG. 9 shows an example first connector 200*a* coupled to an adjacent second example connector 200*b*. As depicted in FIG. 9, male flange 214*a* is inserted into male flange receiving channel 222*b* of female flange 220*b*. Engagement of adjacent connectors 200*a* and 200*b* via the complimentarily configured flanges (i.e., male flange 214*a* and female flange 222*b*) aligns adjacent vertical member abutting walls 202*a* and 202*b* perpendicularly (i.e., disposed at substantially a 90° angle relative to each other). In this configuration, adjacent connectors 200*a* and 200*b* can be attached to adjacent faces of a vertical member. As shown in FIGS. 10 and 11, adjacent connectors 200*a* and 200*b* are attached to adjacent faces 116*b* and 114*b* of vertical frame member 104*a*, respectively.

Returning to FIG. 9, connectors 200*a* and 200*b* are further engaged with two cap members 232*b* and 232*a* to form a vertical member sleeve 230. Cap members 232*a* and 232*b* each include a wall 234 (i.e., 234*a* and 234*b*, respectively), a male flange 236 (i.e., 236*a* and 236*b*, respectively), and a female flange 238 (i.e., 238*a* and 238*b*, respectively). The cab member wall is a vertical member abutting wall (i.e., a vertical member capping wall).

Male flange 236 and female flange 238 are disposed on opposing sides of wall 234. Male flange 236 has substantially the same configuration as male flange 214, and female flange 238 has substantially the same configuration as female flange 218. As shown in FIGS. 10 and 11, walls 234*a* and 234*b* further include holes 240*a* and 240*b*, respectively, for attachment to a horizontal member attachment region of a vertical member. In the present example, holes 240*a* and 240*b* include two holes. In other examples, holes 240*a* and 240*b* can include more or fewer holes.

Similar to the engagement between male flange 214*a* and 218*b* described above, male flange 214*b* is engaged with female flange 238*a*, male flange 236*b* is engaged with female flange 218*a*, and male flange 236*a* is engaged with female flange 238*b*. Therefore, each set of adjacent walls (i.e., walls 202*a* and 234*b*, walls 234*b* and 232*a*, and walls 232*a* and 202*b*) are perpendicular to each other (i.e., disposed at substantially a 90° angle relative to each other).

As stated above, engaged cap members 232*a* and 232*b* and connectors 200*a* and 200*b* collectively form vertical member sleeve 230. As depicted in FIGS. 10 and 11, vertical member sleeve 230 is configured to encompass a vertical member, such as vertical member 104*a* (also shown in FIG. 2). Further vertical member sleeve 230 is configured to be attached to the vertical member at a horizontal member attachment region, such as horizontal member attachment region 122*a* (also shown in FIGS. 3A and 3B).

Although not specifically shown in FIGS. 10 and 11, it will be appreciated that each of connectors 200*a* and 200*b* include holes (such as holes 210 shown in FIG. 7) for alignment with and attachment to holes in the vertical frame member at the horizontal member attachment region (such as holes 130 and 132 show in FIGS. 3A and 3B). When holes in the vertical member-abutting walls and the vertical member faces are aligned, fastening members (not specifically shown in this view) can be inserted through the aligned holes for releasable attachment of the connector to the vertical frame member. Further, capping member holes 240*a* and 240*b* can also be aligned with holes in the face of the vertical frame members for attachment of the capping members to the vertical frame member via fastening members 182 (shown in FIG. 11).

As shown in FIGS. 7-10, side walls 204 and end wall 206 form an insertion portion 242. The insertion portion is configured to be insertable into a central void (e.g., central void 182) and a cutout portion (e.g., cutout portion 165) of a horizontal frame member. As depicted in the example shown in FIGS. 10 and 11, insertion portions 242*a* and 242*b* are insertable into central voids 182*a* and 182*b* and cutout portions 165*a* and 165*b*, respectively.

The insertion portions can be inserted into the central void and through the cutout portion until holes 212 are aligned with holes 164 and a perimeter edge 184 of the central void is abutted to a face of the vertical frame member. In the specific example shown in FIGS. 10 and 11, holes 164*a* can be aligned with holes 212*a* and perimeter edge 184*a* can be abutted to face 116*b* of vertical member 104*a*. Further, holes 164*b* can be aligned with holes 212*b* and perimeter edge 184*b* can be abutted to face 114*b* of vertical member 104*a*. As shown in FIG. 11, fastening members 186 are inserted through aligned holes for releasable attachment of horizontal frame members 164*a* and 164*b* to connectors 200*a* and 200*b*, respectively.

In the example described above and shown in FIGS. 7-11, the universal connectors include engageable flanges (e.g., engageable male and female flanges) at the corners of the vertical member abutting walls. Further, the cap members include engagable flanges that can be engaged with the male and female flanges of the universal connectors. Thus, in this example, the connectors and the cap members have the advantage that they can be perpendicularly aligned relative to an engaged adjacent connector and/or cap member, forming a vertical member sleeve.

The vertical member sleeve is easily assembled around a vertical frame member. Alternatively, the vertical member sleeve can be assembled and then slid over a vertical frame member. The holes in the vertical member sleeve are then aligned with holes in a horizontal member attachment region on the vertical frame member. The connector can be attached to at any desired horizontal frame member attachment region.

Fastening members can then be inserted through the aligned holes for releasable attachment of the vertical member sleeve to the vertical frame member. It will be appreciated that the fastening member can be any suitable fastening member, such as a bolt, screw, snap-fit fastening member, an interlocking fastening member, etc. The cap members can further include finishing plugs over the fastening members to give a finished outward appearance.

It will also be appreciated that a vertical member sleeve can include any desired number of connectors at locations where a horizontal member will be attached to the vertical member, and any desired number of capping members at locations where a horizontal member will not be attached to the vertical member.

In the example shown above, the vertical member sleeve includes two connectors and two capping members for attachment of two horizontal frame members to a vertical frame member. In an alternate example, the vertical member sleeve can include three connectors and one capping member for attachment of three horizontal frame members to a vertical frame member. In another alternate example, the vertical member sleeve can include four connectors and no capping members for attachment of four horizontal frame members to a vertical frame member.

It will be further appreciated that in alternate examples the horizontal frame members can be attached to the vertical members by a different connector. For example, FIGS. 12A-14 show a second example connector, connector 300. Connector 300 includes many similar or identical features to connector 200. Thus, for the sake of brevity, each feature of connector 300 will not be redundantly explained. Rather, key distinctions between connector 300 and connector 200 will be described in detail and the reader should reference the discussion above for features substantially similar between the two connectors.

As depicted in FIGS. 12A-12E, connector 300 has an overall rectangular cuboid shape and includes a vertical member abutting wall 302, two opposing side walls 304, two opposing top/bottom walls 306, and a centrally disposed space 308. Side walls 304 and top/bottom walls 306 are extended outwardly from wall 302. Unlike connector 200, an opposing end relative to vertical member abutting wall 302 is open. Centrally disposed space 308 is within the walls 302, 304, and 306. Thus, universal connector 300 has closed open top face and bottom face and an open end.

Connector 300 has an overall height M, an overall width N, and an overall length O. In one specific example, the height M is 4⅞", the width N is 2⅝", and the length 0 is 6".

Vertical member abutting wall 302 includes holes 310 for attachment of connector 300 to one face of a vertical member (e.g., face 114 of vertical member 104, face 138 of vertical member 106, etc.). For example, a fastening member (not specifically shown) can be inserted through and fastened into one of holes 310 and one of holes 126 when connector 300 is aligned with horizontal member attachment region 126. Further, an additional fastening member can be inserted through and fastened into the other of holes 310 and the other of holes 126.

Figure 13:
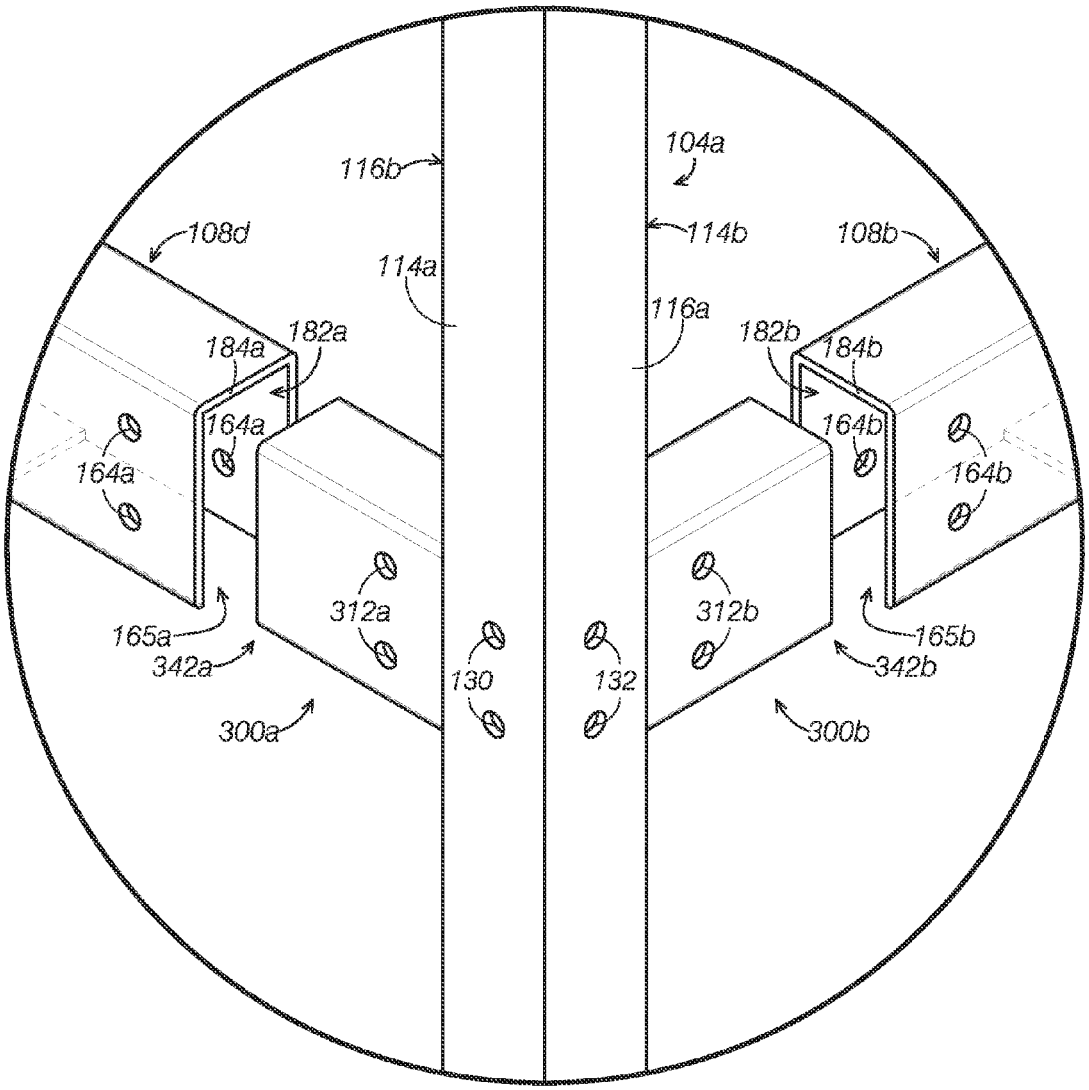
FIG. 13 is an isometric view of two of the second example connectors in an aligned position for engagement with a vertical frame member and two horizontal frame members.
Figure 14:
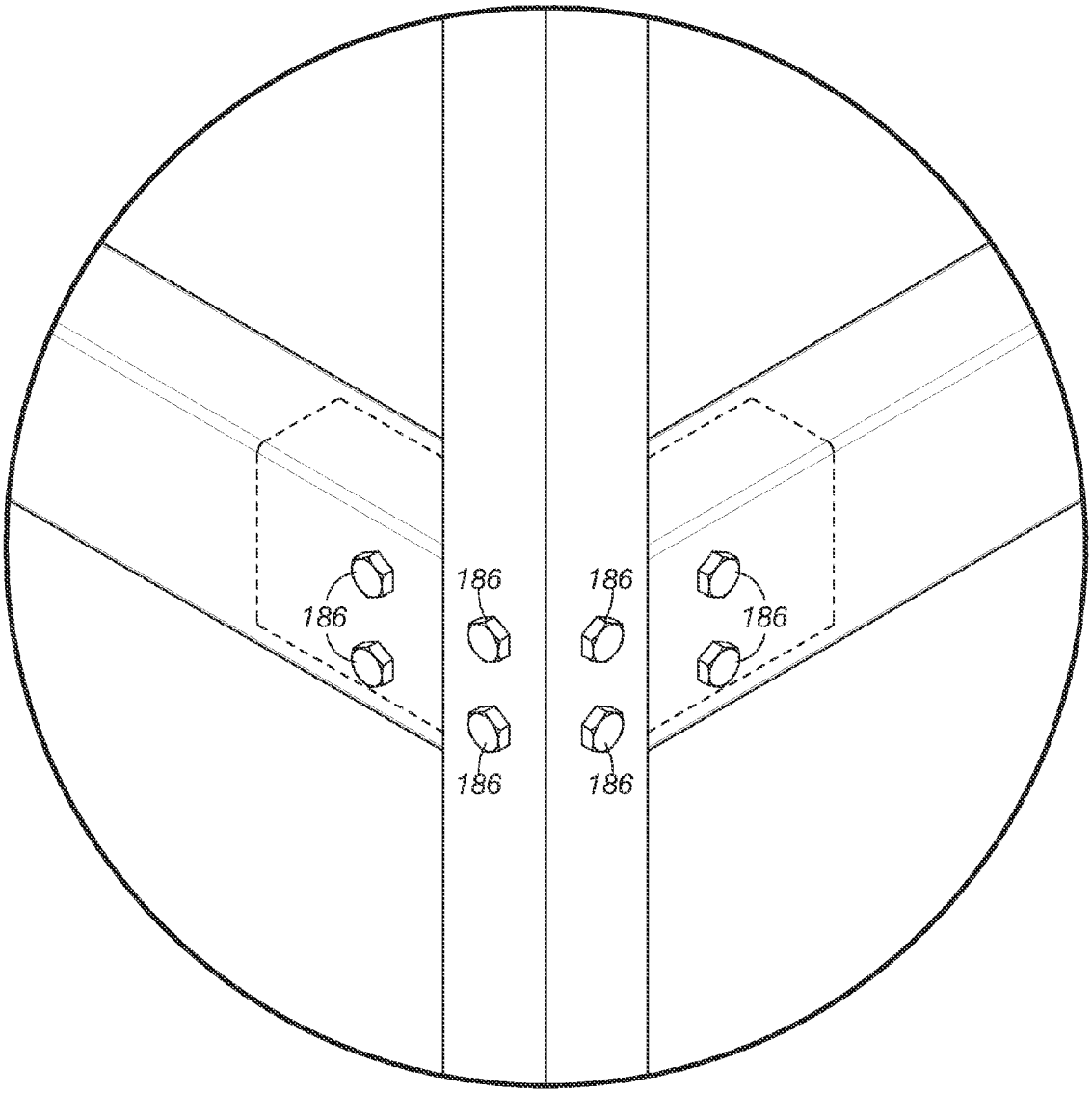
FIG. 14 is an isometric view of two of the second example connectors engaged with the vertical member and the two horizontal frame members of FIG. 13.

Each connector is configured to attach to one face of a vertical frame member in a horizontal member attachment region. A connector can be attached at a location where it is desirable to attach a horizontal frame member. Unlike connector 200, connector 300 is not specifically configured for engagement with other connectors or cap members. FIGS. 13 and 14 depict attachment of horizontal members 108*b* and 108*d* to vertical member 104*a* using connectors 300 (i.e., 300*a* and 300*b*).

Although not specifically shown in FIGS. 13 and 14, it will be appreciated that each of connectors 300*a* and 300*b* include holes (such as holes 310 shown in FIGS. 12A-12E) for alignment with and attachment to holes in the vertical frame member at the horizontal member attachment region (such as holes 130 and 132 show in FIGS. 3A and 3B). When holes in the vertical member-abutting walls and the vertical member faces are aligned, fastening members (not specifically shown in this view) can be inserted through the aligned holes for releasable attachment of the connector to the vertical frame member.

As shown in FIGS. 12A, 12B, 12E, and 13, side walls 304 and top/bottom walls 306 form an insertion portion 342. The insertion portion is configured to be insertable into a central void (e.g., central void 182) and a cutout portion (e.g., cutout portion 165) of a horizontal frame member (e.g., horizontal frame member 108). As depicted in the example shown in FIGS. 13 and 14, insertion portions 342*a* and 342*b* are insertable into central voids 182*a* and 182*b* and through cutout portions 165*a* and 165*b*, respectively.

The insertion portions can be inserted into the central voids and through the cutout portions until holes 312 are aligned with holes 164 and perimeter edge 184 of the central void is abutted to a face of the vertical frame member. In the specific example shown in FIGS. 13 and 14, holes 164*a* can be aligned with holes 312*a* and perimeter edge 184*a* can be abutted to face 116*b* of vertical member 104*a*. Further, holes 164*b* can be aligned with holes 312*b* and perimeter edge 184*b* can be abutted to face 114*b* of vertical member 104*a*. As shown in FIG. 14, fastening members 186 are inserted through aligned holes for releasable attachment of horizontal frame members 164*a* and 164*b* to connectors 300*a* and 300*b*, respectively.

In the example described above and shown in FIGS. 12A-14, the universal connectors are individually connectable to vertical frame member and do not engage with each other. Thus, in this example, the connectors have the advantage that they can be quickly attached without engagement to and alignment with other connectors and/or cap members.

Figure 15A:
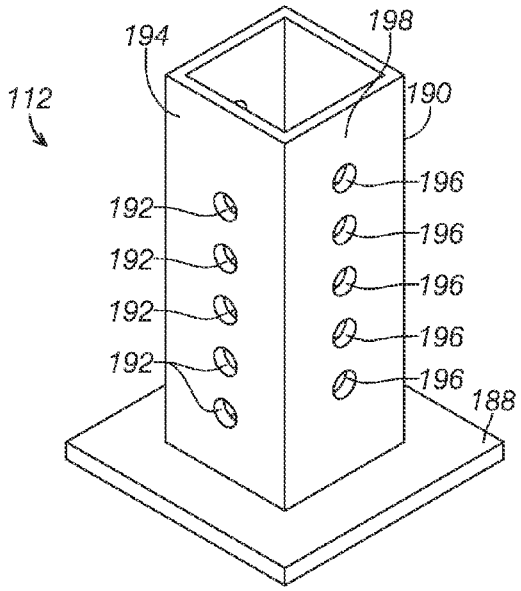
FIGS. 15A-15E are top isometric, bottom isometric, a first side plan, top plan, and a second side plan views, respectively, of a foot member, the second side view being a 90° rotation relative to the first side view.
Figure 15C:
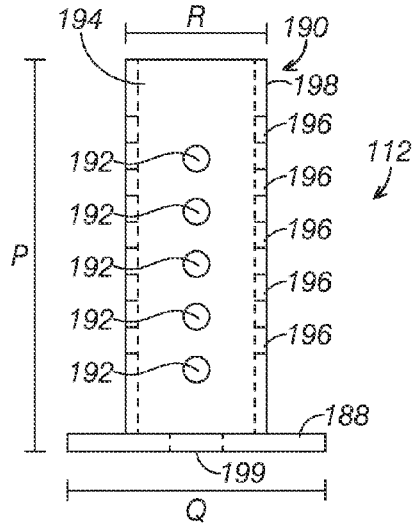
Figure 15D:
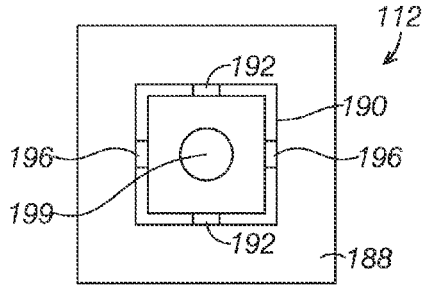
Figure 15B:
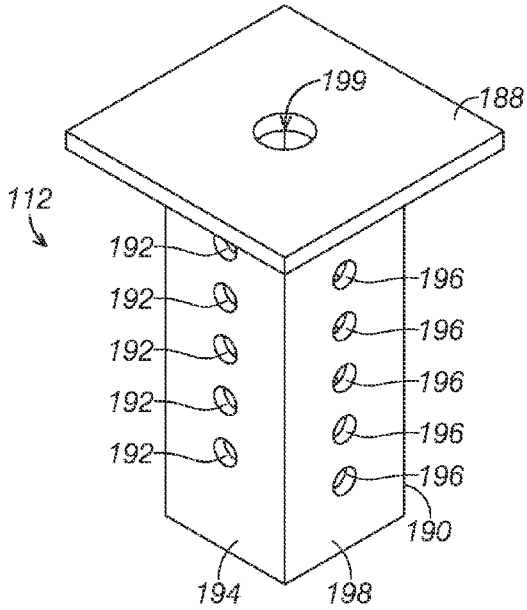
Figure 15E:
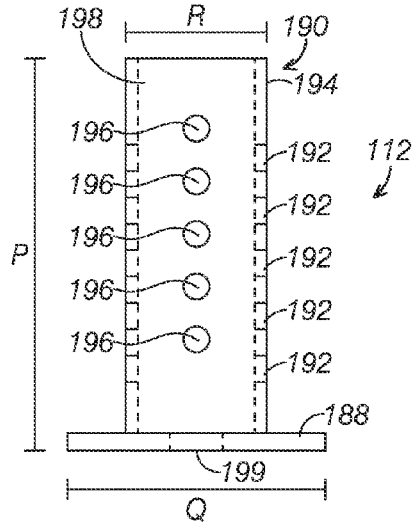
Figure 16:
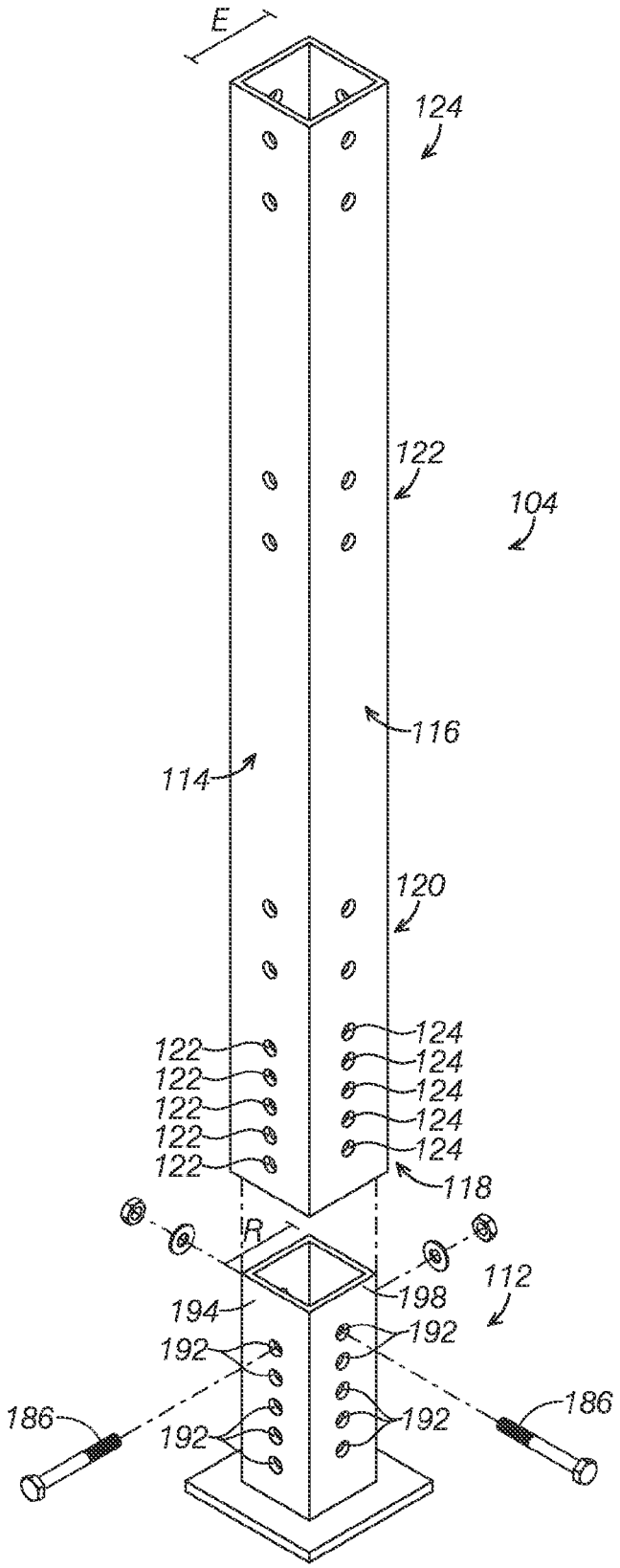
FIG. 16 is an exploded view of the foot member of FIGS. 13A-13E engaged with the first vertical frame member of FIGS. 3A and 3B.

Turning now to FIGS. 15A-16, foot member 112 will now be described. Foot member 112 includes a base 188 and an elongate body 190. Base 188 and a cross-section of body 190 each have a generally square shape. In the present example, body 190 has a width R, base 188 has a width Q, and foot member 112 has an overall height P. In one specific example, R is 3", Q is 5½", and P is 8½".

Body 190 includes a plurality of laterally extended holes 192 that extend through a first face 194 to an opposing face. Body 190 includes a plurality of laterally extended holes 196 that extend through a second face 198 to an opposing face. As shown in FIGS. 15A-15E, holes 192 are offset relative to holes 196. In other examples, holes 192 and 196 can be aligned. In the present example, holes 192 and 196 each include five holes. In other examples, holes 192 and 196 may include more of fewer holes.

Base 188 is disposed at a bottom side of body 190. Base 188 is configured to contact a ground or foundation and provides a greater surface area for distribution of weight of the modular house on the ground/foundation. In the example of FIGS. 15A-15E, base 188 includes a central hole 199. A fastening member (not specifically shown) can be inserted through hole 199 for releasable attachment of the foot member to the ground or foundation. In alternate examples, the foot member can exclude the central hole in the base. In even other examples, the foot member can exclude the base.

The foot member is configured to be releasably and adjustably attached to foot member attachment region of a vertical frame member. FIG. 16 shows an example exploded view of foot member 112 and vertical member 104. In this example, the width E is greater than the width R, and therefore foot member 112 can be slid inside of vertical frame member 104. In the example of FIG. 16, face 116 is aligned with face 198 and face 114 is aligned with face 194, however, in alternate examples and/or as desired, the vertical frame member can be rotated 90°.

As shown in FIG. 16, holes 122 and 124 can be aligned with holes 192 and 196, respectively. The sets of holes can be partially or entirely aligned as desired to adjust a distance between a bottom of the vertical frame member and the ground/foundation. At any of the aligned holes, one or more fastening members can be inserted through for releasable attachment of the foot member and the vertical frame member. In the present example, one of fastening members 186 can be inserted through one of holes 122 aligned with one of holes 192, and another of fastening members 186 can be inserted through one of holes 124 aligned with one of holes 196.

It will be appreciated that the foot member is configured to be attached to a vertical member in a variety of possible positions. Any of the holes in the foot member attachment region of the vertical member can be aligned with any of the holes in the foot member for releasable attachment of the vertical member and the foot member. Further, a distance of the bottom of the vertical member to the ground/foundation is adjustable to a high degree because of the offsetting of the holes and the number of holes in the foot member attachment region and the foot member.

Vertical members within a frame for a modular house, such as frame 102 (i.e., framing system 102) shown in FIG. 2, can be attached to foot members in various desired positions. Thus, foot members and vertical members are configured so that horizontal attachment regions of the vertical members are aligned/leveled.

For example, if a modular home frame is being assembled on a hillside where a rear portion of the frame is over a lower portion of the hillside, rear vertical frame members (e.g., vertical frame members 106*a* and 106*b*) can be attached to foot members (e.g., 112*f* and 112*e*, respectively) closer to a top of the foot member. In this example, vertical frame members at the front of the house (e.g., 104*a* and 104*b*) that are on a higher portion of the hillside can be attached to foot members closer to a bottom of the foot member. In another example, the frame may be on uneven ground and each vertical member can be attached to the foot member in a manner that levels the horizontal member attachment regions.

Figure 17A:
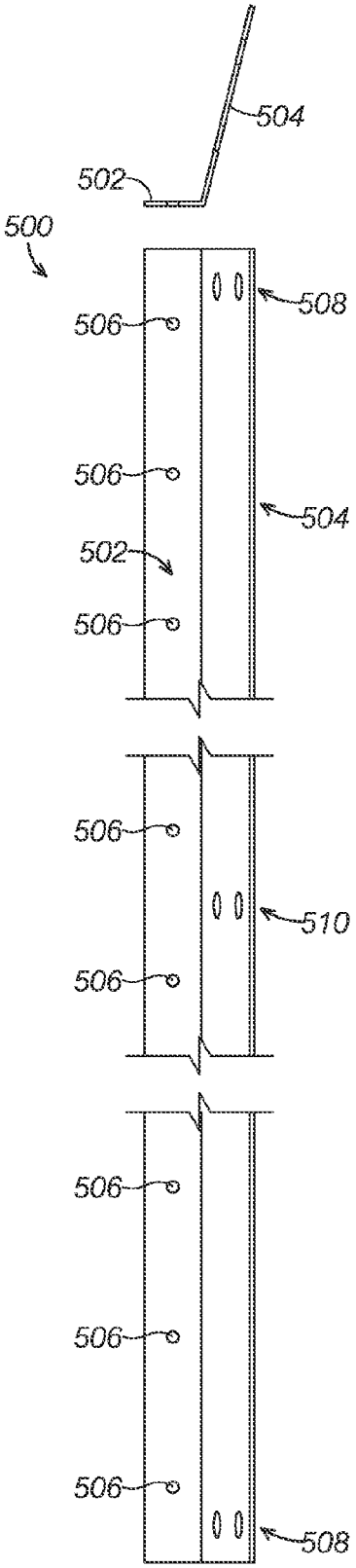
FIGS. 17A and 17B are side plan and top plan views, respectively, of an example roof panel attachment member.
Figure 17B:
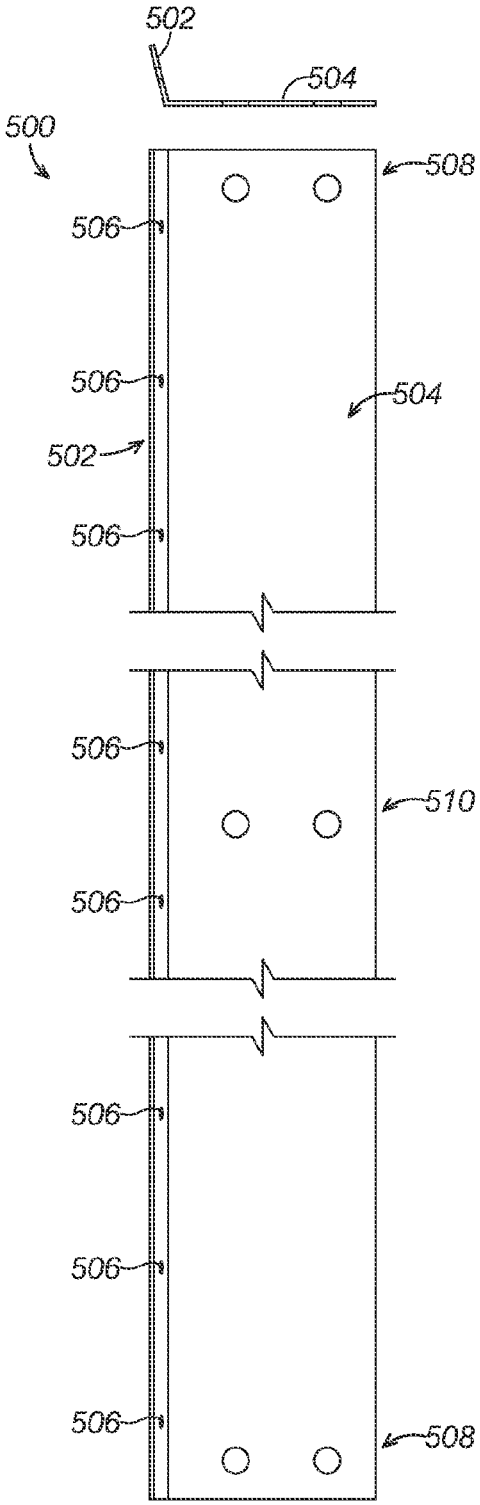
Figure 18A:
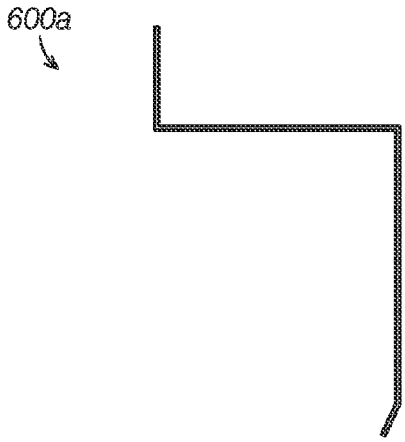
FIGS. 18A-18F side plan views of various example attachment members for attachment of other panels (e.g., floor, side wall, front wall, etc.) to the modular housing framing system.
Figure 18B:
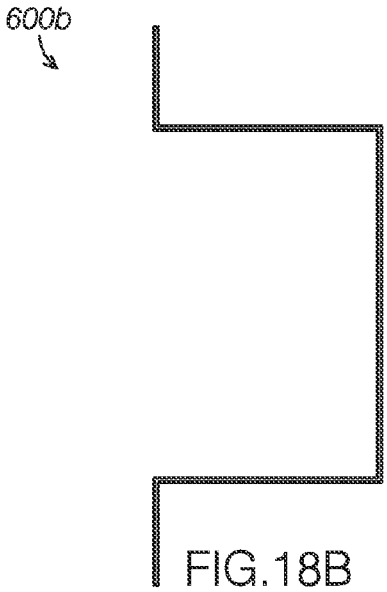
Figure 18C:
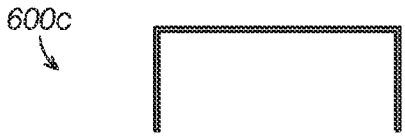
Figure 18D:
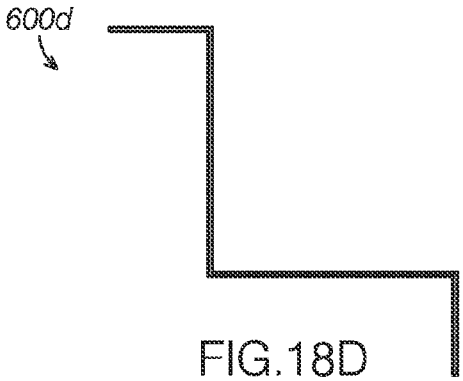
Figure 18E:
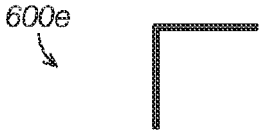
Figure 18F:
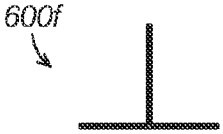

Lastly, FIGS. 17A and 17B and 18A-18F show attachment members for attaching panels to the modular housing framing system (e.g., side wall, floor, roof panels, etc.). Specifically, FIGS. 17A and 17B show an example roof panel attachment member, roof panel attachment member 500. Roof panel attachment member 500 includes a panel attachment wall 502 and a frame member attachment wall 504. The panel attachment wall has a plurality of holes 506 for attachment to a panel (e.g., roof panel 412 shown in FIG. 1) via attachment members. In other examples, the panel attachment wall can alternatively or additionally include a different attachment mechanism (e.g., a snap-fit mechanism, a slide-fit mechanism, etc.) for attachment of the roof panel to the roof panel attachment member. Frame member attachment wall 504 includes holes 508 at opposing ends and central holes 510 for attachment to a horizontal member at vertical member attachment regions.

FIGS. 18A-F show example extruded flashing attachment members 600 (600*a-j*) for attachment of other panels (e.g., floor and side wall panels) to the modular housing framing system. Various configurations for flashing attachment members are provided for attachment of panels at various regions of the frame (i.e., frame 102).

It will be appreciated that the above described modular housing framing components can be assembled in any desired configuration for a modular house. The house can include multiple levels and/or include multiple rooms on a level. Further, the house can be disassembled and reassembled as desired. A universal threaded fastening member can be used for attachment of framing components. The fastening member can be fastened with or without the aid of power tools.

The framing system is suitable for construction by professional or non-professional users. Horizontal members can be attached to any desired face of a vertical member via insertable connectors within the horizontal member attachment regions of the vertical frame members. Connection at horizontal member attachment regions allows for the horizontal members to be disposed at the same height within the frame (i.e., allows for horizontal frame members to be level). Further, foot members are attachable to the vertical members in various positions to allow vertical members to be disposed at the same height within the frame (i.e., allows vertical frame members to be level).

The framing system components can be rectangular and square hollow tubes to allow for the materials to be light weight for easier manipulation during construction and reduced shipping and manufacturing costs. The framing system components can be fabricated from a light weight material, such as aluminum, to further reduce weight and aid in ease of manipulation during construction and reduce shipping and manufacturing costs.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A modular house framing system, comprising:

a plurality of elongate rectangular vertical frame members, each of the plurality of vertical frame members having an upper vertical end and a lower vertical end, each of the upper vertical end and the lower vertical end having a horizontal member attachment mechanism in a horizontal member attachment region;

a plurality of elongate rectangular horizontal frame members, each of the plurality of horizontal frame members having a first horizontal end and a second opposing horizontal end, each of the first horizontal end and the second horizontal end having a vertical member attachment mechanism and an end face in a vertical member attachment region, the end face being open and including a central void that is at least partially extended into a body of the horizontal frame member;

a plurality of connectors, each of the plurality of connectors having a generally rectangular cuboidal projection, the generally rectangular cuboidal projection being at least a pair of side walls outwardly extended from a vertical member abutting wall, the projection being insertable into the central void of the horizontal frame member and being complimentarily configured with a shape of an internal perimeter of the central void, each of the plurality of connectors being attachable to the horizontal member attachment mechanism and the vertical member attachment mechanism; and a plurality of fastening members, each of the plurality of fastening members configured to fasten any of the plurality of connectors to any of the plurality of vertical frame members and any of the plurality of horizontal frame members to any of plurality of connectors, wherein one of the plurality of connectors is configured to be attachable to one face of one of the plurality of vertical members in the horizontal member attachment region, and another of the plurality of connectors is configured to be attachable to an adjacent face of one of the plurality of vertical members in the horizontal member attachment region, and wherein each of the plurality of connectors has a female flange on a first side of the vertical member abutting wall and a male flange on a second side of the vertical member abutting wall, the female flange configured to engage with a male flange of an adjacent connector.

2. The modular house framing system of claim 1, wherein the vertical member attachment mechanism and the horizontal member attachment mechanism are each selectively releasable.

3. The modular house framing system of claim 1, wherein the horizontal member attachment mechanism comprises at least one of the plurality of fastening members and at least one vertical member lateral through hole in the horizontal member attachment region for attachment to at least one of the plurality of connectors, the at least one of the plurality of connectors having at least one connector longitudinal through hole in the vertical member abutting wall, and the at least one vertical member lateral through hole is alignable with the at least one connector longitudinal through hole for insertion and fastening of the at least one of the plurality of fastening members.

4. The modular house framing system of claim 1, wherein the vertical member attachment mechanism comprises at least one of the plurality of fastening members and at least one horizontal member lateral through hole in the vertical member attachment region for attachment of at least one of the plurality of connectors, the at least one of the plurality of connectors having at least one connector lateral through hole extended through the pair of side walls, and the at least one horizontal member lateral through hole is alignable with the at least one connector lateral through hole for insertion and fastening of the at least one of the plurality of fastening members.

5. The modular house framing system of claim 1, wherein each of the plurality of horizontal frame members is a rectangular tube, the central void of the first horizontal end being continuous with the central void of the second horizontal end.

6. The modular house framing system of claim 1, wherein each of the plurality of vertical frame members is a rectangular tube, the rectangular tube having an open face at each of a first end and a second end of the vertical frame member.

7. The modular house framing system of claim 1, further comprising a plurality of foot members configured to contact a surface that the modular house framing system is assembled upon and provide a vertical frame member adjustable height mechanism, each of the plurality of foot members having a rectangular cuboid body, each of the plurality of foot members being attachable to one of the plurality of vertical frame members.

8. The modular house framing system of claim 7, wherein each of the plurality of foot members further comprises a flat base, the flat base being fixed to one end of the foot member and having a perimeter that extends beyond a perimeter of the rectangular cuboid body, the base configured to contact the surface.

9. The modular house framing system of claim 7, wherein each of the plurality of vertical frame members includes a foot member attachment region disposed on the lower vertical end below the horizontal member attachment region, each of the plurality of foot members being releasably attachable to a foot member attachment region in a plurality of height positions via a foot member attachment mechanism.

10. The modular house framing system of claim 9, wherein each of the plurality of vertical frame members is an elongate rectangular tube, each of the plurality of foot members configured to be insertable through an open bottom face of one of the plurality of vertical frame members.

11. The modular house framing system of claim 7, wherein the vertical member attachment mechanism comprises at least one of the plurality of fastening members, a plurality of vertical member through holes in the foot member attachment region, and a plurality of foot member through holes in the rectangular cuboid body, and at least one of the plurality of vertical member through holes is alignable with at least one of the plurality of foot member through holes for insertion and fastening of the at least one of the plurality of fastening members.

12. The modular house framing system of claim 1, further comprising a plurality of cap members, each of the plurality of cap members having a vertical member capping wall with a female flange on a first side of the vertical member capping wall and a male flange on a second side of the vertical member capping wall, the female flange configured to engage with a male flange of one of an adjacent connector and an adjacent capping member.

13. The modular house framing system of claim 12, further comprising a vertical member sleeve, the vertical member sleeve being four members engaged around a vertical member at the horizontal member attachment region, the four members being engaged via male flanges engaged with adjacent female flanges, the four members being two or more connectors and one or more cap members.

14. The modular house framing system of claim 1, wherein each of the plurality of horizontal frame members is a rectangular tube, the central void of the first horizontal end being continuous with the central void of the second horizontal end.

15. The modular house framing system of claim 1, wherein each of the plurality of vertical frame members is a rectangular tube, the rectangular tube having an open face at each of a first end and a second end of the vertical frame member.

16. The modular house framing system of claim 15, further comprising a plurality of foot members configured to contact a surface that the modular house framing system is assembled upon and provide a vertical frame member adjustable height mechanism, each of the plurality of foot members having a rectangular cuboid body and a flat base attached to one end of the body, each of the plurality of foot members being configured to be insertable into one of the plurality of vertical frame members and attachable in a plurality of height positions at a foot member attachment region of the vertical frame member, the foot member attachment region being disposed on the lower vertical end of the vertical member below the horizontal member attachment region.

17. A modular house framing system, comprising:

a plurality of elongate vertical frame members;

a plurality of elongate horizontal frame members, each of the plurality of horizontal frame members being attachable to at least one of the plurality of vertical frame members and having a first end and a second opposing end, each of the first end and the second opposing end having an open end face for a central void that is at least partially extended into a body of the horizontal frame member;

a plurality of connectors each having a projection and a vertical frame member abutting wall, the projection being insertable into the central void of the horizontal frame member and the vertical member abutting wall being attachable to one of the plurality of vertical frame members; and a plurality of fastening members configured to fasten each of plurality of connectors to one of the plurality of vertical frame members and one of the plurality of horizontal frame members, wherein one of the plurality of connectors is configured to be attachable to a first face of a vertical member of the plurality of vertical members, and another of the plurality of connectors is configured to be attachable to a second adjacent face of the vertical member, and wherein each of the plurality of connectors includes a female flange on a first side of the vertical member abutting wall and a male flange on a second side of the vertical member abutting wall, the female flange configured to engage with a male flange of an adjacent connector.

18. The modular house framing system of claim 17, further comprising a plurality of cap members, each of the plurality of cap members having a vertical member capping wall with a female engagement partner on a first side of the vertical member capping wall and a male engagement partner on a second side of the vertical member capping wall, the female engagement partner configured to engage with a male engagement partner of one of an adjacent connector and an adjacent capping member.

19. The modular house framing system of claim 18, further comprising a vertical member sleeve, the vertical member sleeve being four members engaged around a vertical member at the horizontal member attachment region, the four members being engaged via male engagement partners engaged with adjacent female engagement partners, the four members being two or more connectors and one or more cap members.

* * * * *